US009336711B2

(12) United States Patent
Toyomura et al.

(10) Patent No.: US 9,336,711 B2
(45) Date of Patent: May 10, 2016

(54) DISPLAY DEVICE AND DISPLAY DRIVING METHOD

(75) Inventors: Naobumi Toyomura, Kanagawa (JP); Katsuhide Uchino, Kanagawa (JP)

(73) Assignee: JOLED Inc., Tokyo (JP)

( * ) Notice: Subject to any disclaimer, the term of this patent is extended or adjusted under 35 U.S.C. 154(b) by 736 days.

(21) Appl. No.: 12/926,617

(22) Filed: Nov. 30, 2010

(65) Prior Publication Data

US 2011/0181626 A1 Jul. 28, 2011

(30) Foreign Application Priority Data

Jan. 28, 2010 (JP) ..... 2010-016352

(51) Int. Cl.
*G09G 5/10* (2006.01)
*G09G 3/32* (2016.01)

(52) U.S. Cl.
CPC ..... *G09G 3/3233* (2013.01); *G09G 2300/0842* (2013.01); *G09G 2310/0251* (2013.01)

(58) Field of Classification Search
CPC ..... G09G 3/06; G09G 3/14
USPC ..... 345/204, 690; 438/10
See application file for complete search history.

(56) References Cited

U.S. PATENT DOCUMENTS 7,283,105 B2 * 10/2007 Dallas et al. ..... 345/32
7,502,040 B2 * 3/2009 Kawae ..... 345/690
8,358,256 B2 * 1/2013 Hamer et al. ..... 345/77
2004/0046164 A1 3/2004 Kobayashi et al.
2005/0057580 A1 * 3/2005 Yamano et al. ..... 345/690
2005/0206590 A1 9/2005 Sasaki et al.

(Continued)

FOREIGN PATENT DOCUMENTS

CN 101436382 A 5/2009
JP 2003-255856 A 9/2003

(Continued)

OTHER PUBLICATIONS

Japanese Office Action issued Sep. 17, 2013 for corresponding Japanese Application No. 2010-016352.

(Continued)

*Primary Examiner* — Calvin C Ma
(74) *Attorney, Agent, or Firm* — Michael Best & Friedrich LLP

(57) ABSTRACT

Disclosed herein is a display device including a pixel array configured to include pixel circuits arranged in a matrix having a light emitting element, driving transistor, sampling transistor, and hold capacitor. The display device further includes a signal selector, driving control scanner, and writing scanner. The signal selector alternately carries out supply of a video signal voltage in order from a beginning line to an end line in a unit and supply of a video signal voltage in order from an end line to a beginning line in a unit. The writing scanner outputs the pulse to the writing control lines in such a way that input of a video signal voltage in order from a beginning line to an end line in a unit and input of a video signal voltage in order from an end line to a beginning line in a unit are alternately carried out.

18 Claims, 11 Drawing Sheets

(56) References Cited

U.S. PATENT DOCUMENTS

| | | | | |
|---|---|---|---|---|
| 2005/0243024 | A1* | 11/2005 | Sempel et al. | 345/55 |
| 2006/0007206 | A1* | 1/2006 | Reddy et al. | 345/204 |
| 2009/0081816 | A1* | 3/2009 | Yamazaki et al. | 438/10 |
| 2009/0096725 | A1* | 4/2009 | Kretz et al. | 345/82 |
| 2009/0109142 | A1* | 4/2009 | Takahara | 345/76 |
| 2009/0122047 | A1* | 5/2009 | Yamamoto et al. | 345/211 |
| 2009/0179831 | A1* | 7/2009 | Yamashita et al. | 345/76 |
| 2009/0251493 | A1 | 10/2009 | Uchino et al. | |
| 2009/0322730 | A1* | 12/2009 | Yamamoto et al. | 345/213 |
| 2010/0045690 | A1* | 2/2010 | Handschy et al. | 345/549 |
| 2010/0165009 | A1* | 7/2010 | Mori et al. | 345/690 |

FOREIGN PATENT DOCUMENTS

| | | | |
|---|---|---|---|
| JP | 2003-271095 | A | 9/2003 |
| JP | 2007-133282 | A | 5/2007 |
| JP | 2009-139928 | A | 6/2009 |
| JP | 2009-237041 | A | 10/2009 |

OTHER PUBLICATIONS

Chinese Office Action issued Mar. 3, 2014 for corresponding Chinese Application No. 201110024407.4.

* cited by examiner

11

DISPLAY DEVICE AND DISPLAY DRIVING METHOD

BACKGROUND OF THE INVENTION

1. Field of the Invention

The present invention relates to a display device having a pixel array in which pixel circuits are arranged in a matrix and a display driving method thereof, and particularly to a display device employing e.g. an organic electro-luminescence element (organic EL element) as its light emitting element.

2. Description of the Related Art

For example, as disclosed in Japanese Patent Laid-Open No. 2003-255856 and Japanese Patent Laid-Open No. 2003-271095, image display devices employing an organic EL element for the pixels have been developed. The organic EL element is a self-luminous element and therefore has the following advantages over e.g. a liquid crystal display device: higher image visibility, no necessity for a backlight, higher response speed, etc. Furthermore, the luminance level (gray-scale) of each light emitting element can be controlled based on the value of the current flowing through the light emitting element (so-called current-control type).

As the driving system of the organic EL display, a simple-matrix system and an active-matrix system are known, similarly to the liquid crystal display. The simple-matrix system has problems of e.g. difficulty in realization of a large-scale, high-definition display although having a simple configuration. Therefore, presently development of the active-matrix system is being actively promoted. In this system, the current flowing to the light emitting element inside each pixel circuit is controlled by active elements (generally thin film transistor (TFT)) provided inside the pixel circuit.

SUMMARY OF THE INVENTION

The pixel circuit configuration employing the organic EL element is strongly required to achieve improvement of the display quality by e.g. elimination of luminance unevenness from pixel to pixel and enhancements in the luminance, the definition, and the frame rate (frequency). Furthermore, development for increasing the panel size is also being promoted.

From these perspectives, a wide variety of various configurations have been studied. For example, as disclosed in Japanese Patent Laid-Open No. 2007-133282, there have been proposed various kinds of pixel circuit configuration and operation to cancel variation in the threshold voltage and mobility of the driving transistor from pixel to pixel to thereby allow elimination of luminance unevenness from pixel to pixel.

There is a desire for the present invention to realize pixel circuit operation suitable for both frequency enhancement and panel size increase as the operation of a display device employing the organic EL element.

According to one embodiment of the present invention, there is a display device including:

a pixel array configured to include pixel circuits arranged in a matrix, each of the pixel circuits having a light emitting element, a driving transistor that applies a current dependent on a gate-source voltage of the driving transistor to the light emitting element through application of a driving voltage between drain and source of the driving transistor, a sampling transistor that is turned on to input a signal line voltage to a gate of the driving transistor, and a hold capacitor that is connected between the gate and source of the driving transistor and holds a threshold voltage of the driving transistor and an input video signal voltage;

a signal selector configured to supply, as the signal line voltage, a threshold correction reference voltage and video signal voltages for the pixel circuits in a unit to signal lines disposed on columns on the pixel array in a horizontal period corresponding to the number of horizontal lines of one unit, if a plurality of horizontal lines are grouped into one unit about the pixel circuits in the pixel array;

a driving control scanner configured to give a power supply pulse to power supply control lines disposed on rows on the pixel array and apply a driving voltage to the driving transistor in the pixel circuit; and a writing scanner configured to give a scanning pulse to writing control lines disposed on the rows on the pixel array to control the sampling transistor in the pixel circuit, the writing scanner allowing input of the threshold correction reference voltage to the pixel circuits in such a way that threshold correction operation is simultaneously carried out in the pixel circuits in a period of one light-emission cycle by the scanning pulse for the pixel circuits in one unit, the writing scanner allowing sequential input of a video signal voltage to each of the pixel circuits of the horizontal lines in a unit after completion of threshold correction operation, wherein the signal selector alternately carries out supply of a video signal voltage in order from a beginning line to an end line in a unit and supply of a video signal voltage in order from an end line to a beginning line in a unit, as output of a video signal voltage to the signal line, and the writing scanner outputs the scanning pulse to the writing control lines in such a way that input of a video signal voltage in order from a beginning line to an end line in a unit and input of a video signal voltage in order from an end line to a beginning line in a unit are alternately carried out for the pixel circuits of units.

According to another embodiment of the present invention, there is a display driving method in a display device including a pixel array that includes pixel circuits arranged in a matrix, each of the pixel circuits having a light emitting element, a driving transistor that applies a current dependent on a gate-source voltage of the driving transistor to the light emitting element through application of a driving voltage between drain and source of the driving transistor, a sampling transistor that is turned on to input a signal line voltage to a gate of the driving transistor, and a hold capacitor that is connected between the gate and source of the driving transistor and holds a threshold voltage of the driving transistor and an input video signal voltage, a signal selector that supplies, as the signal line voltage, a threshold correction reference voltage and video signal voltages for the pixel circuits in a unit to signal lines disposed on columns on the pixel array in a horizontal period corresponding to the number of horizontal lines of one unit, if a plurality of horizontal lines are grouped into one unit about the pixel circuits in the pixel array, a driving control scanner that gives a power supply pulse to power supply control lines disposed on rows on the pixel array and applies a driving voltage to the driving transistor in the pixel circuit, and a writing scanner that gives a scanning pulse to writing control lines disposed on the rows on the pixel array to control the sampling transistor in the pixel circuit, the writing scanner allowing input of the threshold correction reference voltage to the pixel circuits in such a way that threshold correction operation is simultaneously carried out in the pixel circuits in a period of one light-emission cycle by the scanning pulse for the pixel circuits in one unit, the writing scanner allowing sequential input of a video signal voltage to each of the pixel circuits of the horizontal lines in a unit after completion of threshold correction operation. The display driving method includes the steps of:

alternately carrying out, by the signal selector, supply of a video signal voltage in order from a beginning line to an end line in a unit and supply of a video signal voltage in order from an end line to a beginning line in a unit, as output of a video signal voltage to the signal line; and outputting, by the writing scanner, the scanning pulse to the writing control lines in such a way that input of a video signal voltage in order from a beginning line to an end line in a unit and input of a video signal voltage in order from an end line to a beginning line in a unit are alternately carried out for the pixel circuits of units, to thereby allow light emission with luminance dependent on an input video signal voltage in the pixel circuits.

According to further embodiment of the present invention, there is a display device including a pixel array configured to include pixel circuits arranged in a matrix. In the pixel array, if a plurality of horizontal lines are grouped into one unit about the pixel circuits in the pixel array, a reference voltage is simultaneously input in the pixel circuits in a unit, a video signal voltage is input in the pixel circuits of horizontal lines in the unit after input of the reference voltage, and order of input of the video signal voltage in the pixel circuits of the horizontal lines in the unit is different from each other between adjacent units.

According to further embodiment of the present invention, there is a display device including a pixel array configured to include pixel circuits arranged in a matrix. In the pixel array, if a plurality of horizontal lines are grouped into one unit about the pixel circuits in the pixel array, a reference voltage is simultaneously input in the pixel circuits in a unit, a video signal voltage is input in the pixel circuits of horizontal lines in the unit after input of the reference voltage, and order of input of the video signal voltage in the pixel circuits of the horizontal lines in the unit is reverse from each other between adjacent units.

According to further embodiment of the present invention, there is display device including a pixel array configured to include pixel circuits arranged in a matrix, each of the pixel circuits having a light emitting element and a driving transistor that allows flowing of a current dependent on an input reference voltage and a video signal voltage. In the pixel array, if a plurality of horizontal lines are grouped into one unit about the pixel circuits in the pixel array, the reference voltage is simultaneously input in the pixel circuits in a unit, the video signal voltage is input in the pixel circuits of horizontal lines in the unit after input of the reference voltage, and order of input of the video signal voltage in the pixel circuits of the horizontal lines in the unit is different from each other between adjacent units.

In these embodiments of the present invention, first, a plurality of horizontal lines are grouped into one unit, and the simultaneous threshold cancel (STC) driving system, in which threshold correction operation is simultaneously carried out in the respective pixel circuits in the same unit, is employed. For example if three horizontal lines are grouped into one unit, the respective pixels of three lines simultaneously carry out the threshold correction operation. By this STC driving, a long period can be ensured as the period of the threshold correction operation even when enhancement in the frame rate is carried out.

In this case, the signal selector supplies the threshold correction reference voltage to the signal line in order to set the gate of the driving transistor to the threshold correction reference voltage in the threshold correction operation. Furthermore, the signal selector sequentially supplies the video signal voltages for the respective pixel circuits to the signal line in order to sequentially give the video signal voltages to the respective pixel circuits (driving transistors) in the unit. For example if one unit is composed of three lines, in three horizontal periods, the signal selector supplies the threshold correction reference voltage, the video signal voltage for the pixel circuit of the first line in the unit, the video signal voltage for the pixel circuit of the second line, and the video signal voltage for the pixel circuit of the third line.

In this case, among the pixel circuits in the unit, difference is generated in the waiting time from the completion of threshold correction operation to writing of the video signal voltage, because the threshold correction operation is simultaneously carried out. In the case of making the respective pixel circuits emit light with the same luminance, attributed to the difference in the waiting time, shading due to luminance difference among the first to third lines (in the unit) occurs, so that a phenomenon in which streaks are visually recognized among the respective units on the screen occurs.

In the embodiments of the present invention, in a certain unit, the video signal voltage is written in the order from the beginning line to the end line in the unit. In the next unit, the video signal voltage is written in the reverse order from the end line to the beginning line in the unit. That is, the signal writing order is alternately inverted in the vertical direction between the even-numbered units and the odd-numbered units. Thereby, in a certain unit, the shading in the unit is in the direction of "bright" to "dark" along the downward direction. In contrast, in the next unit, the shading in the unit is in the direction of "dark" to "bright" along the downward direction. This shading direction inversion is repeated on a unit-by-unit basis. This eliminates the phenomenon in which the boundary between units is visually recognized as a streak.

For a display device that carries out such driving that difference is generated in the gate-source voltage of the driving transistor due to a leakage current in the period from setting of any reference voltage in the respective pixel circuits in a unit to writing of the video signal voltage, it is preferable that the order of input of the video signal voltage be made different (e.g. reverse) from each other between adjacent units, even when this reference voltage is not the threshold correction reference voltage.

In the STC driving, difference is generated in the waiting time from the completion of threshold correction operation to writing of the video signal voltage among the respective pixel circuits in a unit. Thus, in the case of making all pixels emit light with the same luminance, shading occurs in the unit attributed to the difference in the waiting time.

In contrast, in the embodiments of the present invention, the writing order of the video signal voltages for the respective lines in a unit is inverted on a unit-by-unit basis, and thereby the luminance difference at the boundary between units can be cancelled. That is, streak-manner displaying on the screen can be eliminated.

DETAILED DESCRIPTION OF THE PREFERRED EMBODIMENT

An embodiment of the present invention will be described below in the following order.

[1. Configurations of Display Device and Pixel Circuit]

[2. Pixel Circuit Operation Considered in Process of Reaching the Present Invention: Divided Threshold Correction]

[3. Pixel Circuit Operation Considered in Process of Reaching the Present Invention: STC driving]

[4. Pixel Circuit Operation of Embodiment]

[1. Configurations of Display Device and Pixel Circuit]

Figure 1:
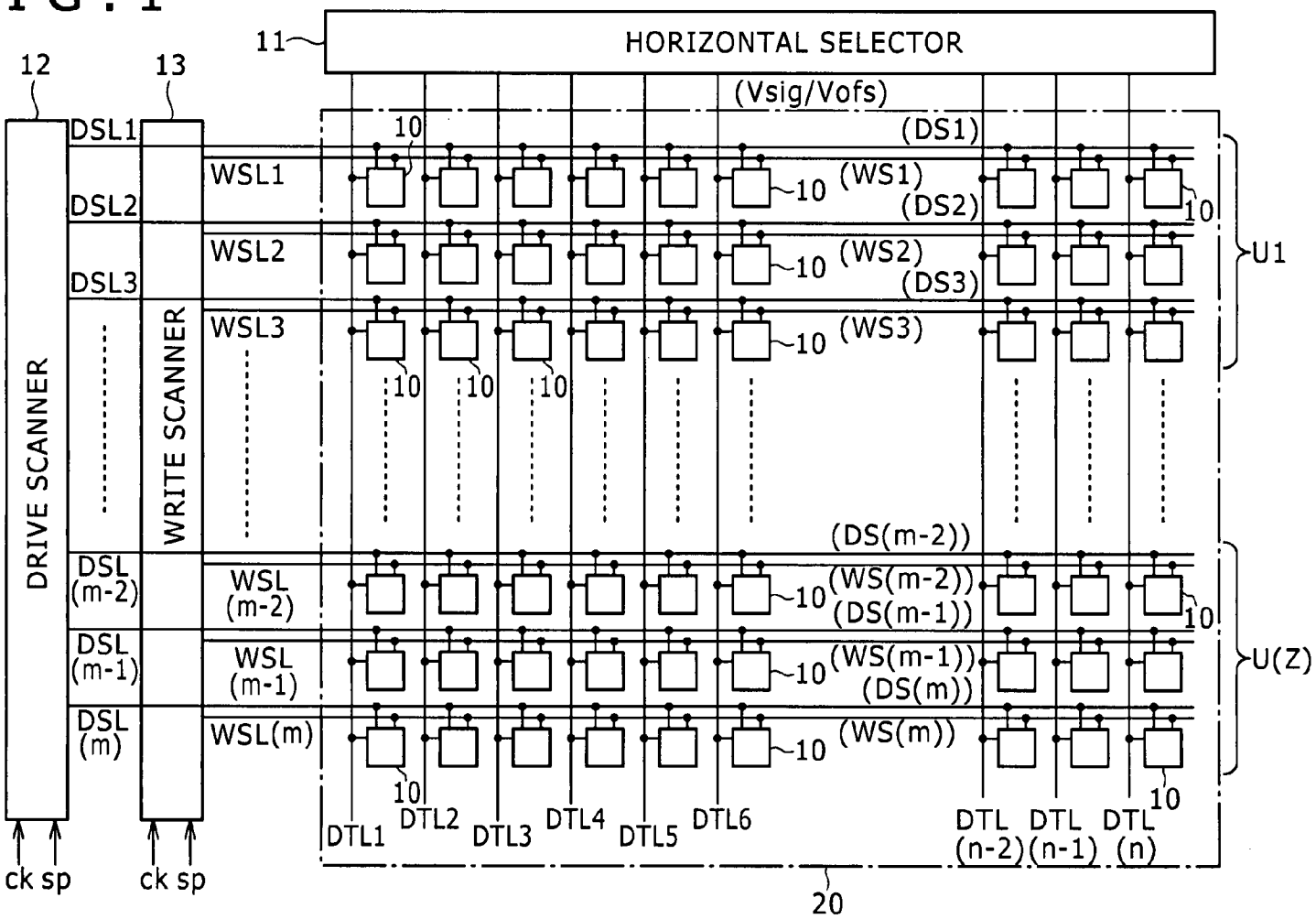
FIG. 1 is an explanatory diagram of the configuration of a display device according to an embodiment of the present invention.

FIG. 1 shows the configuration of an organic EL display device according to the embodiment.

This organic EL display device employs organic EL elements as its light emitting elements and includes pixel circuits 10 that carry out light emission driving based on the active-matrix system.

As shown in the diagram, the organic EL display device has a pixel array 20 in which a large number of pixel circuits 10 are arranged in a matrix along the column direction and the row direction (on m rows×n columns). Each of the pixel circuits 10 serves as a light emitting pixel of any of red (R), green (G), and blue (B), and a color display device is configured through arrangement of the pixel circuits 10 of the respective colors in a predetermined order.

The organic EL display device includes a horizontal selector 11, a drive scanner 12, and a write scanner 13 as the configuration for the light emission driving of each pixel circuit 10.

Furthermore, signal lines DTL1, DTL2, . . . DTL(n) that are selected by the horizontal selector 11 and supply, to the pixel circuits 10, the voltage dependent on the signal value (gray-scale value) of a luminance signal as display data are disposed on the pixel array along the column direction. The number of signal lines DTL1, DTL2, . . . DTL(n) is the same as the number of columns of the pixel circuits 10 (n columns) arranged in a matrix in the pixel array 20.

In addition, on the pixel array 20, writing control lines WSL1, WSL2, . . . WSL(m) and power supply control lines DSL1, DSL2, . . . DSL(m) are disposed along the row direction. Each of the number of writing control lines WSL and the number of power supply control lines DSL is the same as the number of rows of the pixel circuits 10 (m rows) arranged in a matrix in the pixel array 20.

The writing control lines WSL (WSL1 to WSL(m)) are driven by the write scanner 13.

The write scanner 13 sequentially supplies a scanning pulse WS (WS1, WS2, . . . WS(m)) to the writing control lines WSL1 to WSL(m) disposed on the rows at designed predetermined timings to thereby line-sequentially scan the pixel circuits 10 on a row-by-row basis.

The power supply control lines DSL (DSL1 to DSL(m)) are driven by the drive scanner 12. The drive scanner 12 supplies a power supply pulse DS (DS1, DS2, . . . DS(m)) to the power supply control lines DSL1 to DSL(m) disposed on the rows in matching with the line-sequential scanning by the write scanner 13. As the power supply pulse DS (DS1, DS2, . . . DS(m)), a pulse voltage switched between two values, a driving voltage Vcc and an initial voltage Vini, is used.

The drive scanner 12 and the write scanner 13 set the timings of the scanning pulse WS and the power supply pulse DS based on a clock ck and a start pulse sp.

The horizontal selector 11 supplies a signal line voltage as an input signal for the pixel circuit 10 to the signal lines DTL1, DTL2, disposed along the column direction in matching with the line-sequential scanning by the write scanner 13.

In the present embodiment, the horizontal selector 11 supplies, to the respective signal lines, a threshold correction reference voltage Vofs and a video signal voltage Vsig as the signal line voltage.

In the present embodiment, the light emission driving of the pixel is carried out by the STC driving system to be described in detail later. For example, three horizontal lines are grouped into one unit.

As shown in the diagram, in the horizontal lines on m rows, operation for light emission is carried out for each of the respective units as units U1 to U(z) defined in units of three lines. Threshold correction operation is simultaneously carried out in the pixel circuits in the same unit.

As described later, in this case, the horizontal selector 11 supplies, to the respective signal lines, the threshold correction reference voltage Vofs, the video signal voltage Vsig about the first line in the unit, the video signal voltage Vsig about the second line, and the video signal voltage Vsig about the third line as the signal line voltage in three horizontal periods.

In the display device of this embodiment, an example of the signal selector set forth in the claims of the present invention is the horizontal selector 11. An example of the driving control scanner is the drive scanner 12. An example of the writing scanner is the write scanner 13.

Figure 2:
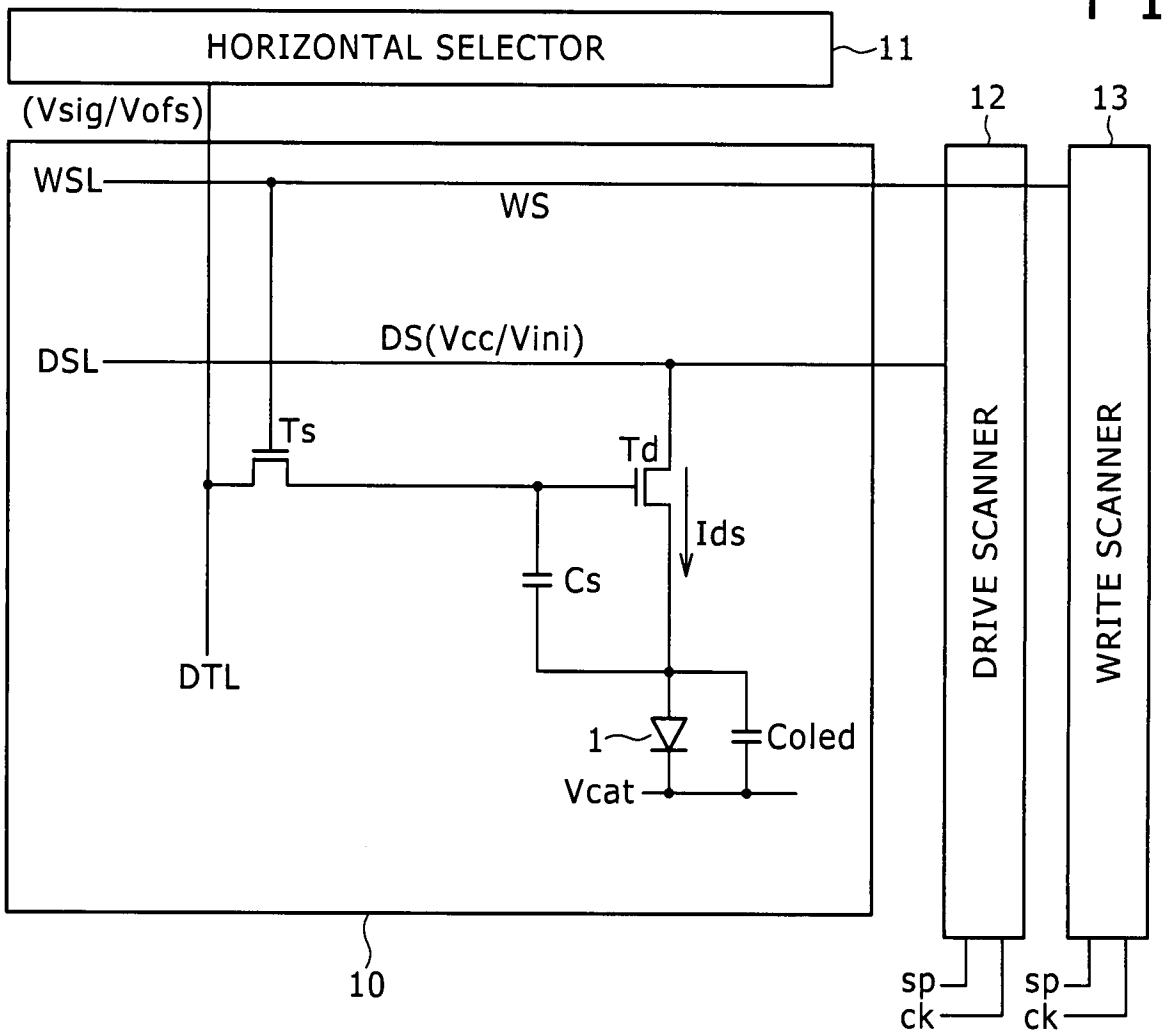
FIG. 2 is a circuit diagram of a pixel circuit of the embodiment.

FIG. 2 shows a configuration example of the pixel circuit 10. This pixel circuit 10 is disposed in a matrix manner like the pixel circuits 10 in the configuration of FIG. 1.

For simplification, FIG. 2 shows only one pixel circuit 10 disposed at the intersection of the signal line DTL, the writing control line WSL, and the power supply control line DSL.

This pixel circuit 10 includes an organic EL element 1 serving as a light emitting element, a hold capacitor Cs, and n-channel thin film transistors (TFTs) serving as a sampling transistor Ts and a driving transistor Td. A capacitor Coled is the parasitic capacitor of the organic EL element 1.

One terminal of the hold capacitor Cs is connected to the source of the driving transistor Td, and the other terminal thereof is connected to the gate of the driving transistor Td.

The light emitting element in the pixel circuit 10 is e.g. the organic EL element 1 having a diode structure and has an anode and a cathode. The anode of the organic EL element 1 is connected to the source of the driving transistor Td, and the cathode is connected to a predetermined line (cathode potential Vcat).

One of the drain and source of the sampling transistor Ts is connected to the signal line DTL, and the other is connected to the gate of the driving transistor Td.

The gate of the sampling transistor Ts is connected to the writing control line WSL.

The drain of the driving transistor Td is connected to the power supply control line DSL.

The light emission driving of the organic EL element 1 is basically as follows.

At the timing when the video signal voltage Vsig is applied to the signal line DTL, the sampling transistor Ts is turned on by the scanning pulse WS given from the write scanner 13 by the writing control line WSL. Due to this operation, the video signal voltage Vsig from the signal line DTL is written to the hold capacitor Cs.

The driving transistor Td makes a current Ids flow to the organic EL element 1 by current supply from the power supply control line DSL supplied with the driving potential Vcc by the drive scanner 12, to thereby make the organic EL element 1 emit light.

At this time, the current Ids has the value dependent on the gate-source voltage Vgs of the driving transistor Td (value dependent on the voltage held in the hold capacitor Cs), and the organic EL element 1 emits light with the luminance dependent on this current value.

That is, in this pixel circuit 10, the gate-applied voltage of the driving transistor Td is changed by writing the video signal voltage Vsig from the signal line DTL to the hold capacitor Cs, and thereby the value of the current flowing to the organic EL element 1 is controlled to obtain the desired grayscale of the light emission.

The driving transistor Td is so designed as to operate in the saturation region, and therefore the driving transistor Td serves as a constant current source having the value represented by the following Equation 1:

$$Ids=(1/2)\cdot\mu\cdot(W/L)\cdot Cox\cdot(Vgs-Vth)^2 \quad \text{(Equation 1)}$$

In this equation, Ids denotes the current flowing between the drain and source of the transistor operating in the saturation region. μ denotes the mobility. W denotes the channel width. L denotes the channel length. Cox denotes the gate capacitance. Vth denotes the threshold voltage of the driving transistor Td.

As is apparent from Equation 1, the drain current Ids is controlled based on the gate-source voltage Vgs in the saturation region. Because the gate-source voltage Vgs is kept constant, the driving transistor Td operates as a constant current source and can make the organic EL element 1 emit light with constant luminance.

In this manner, basically, operation of writing the video signal value (grayscale value) Vsig to the hold capacitor Cs is carried out in the pixel circuit 10 in each frame period. Thereby, the gate-source voltage Vgs of the driving transistor Td is decided depending on the grayscale to be displayed.

Furthermore, the driving transistor Td operates in the saturation region to thereby function as a constant current source for the organic EL element 1 and make the current dependent on the gate-source voltage Vgs flow to the organic EL element 1. Due to this operation, light emission with the luminance dependent on the grayscale value of the video signal is carried out in the organic EL element 1 in each frame period.

[2. Pixel Circuit Operation Considered in Process of Reaching the Present Invention: Divided Threshold Correction]

The pixel circuit operation considered in the process of reaching the present invention will be described below. This operation is circuit operation including threshold correction operation and mobility correction operation for compensating uniformity deterioration attributed to variation in the threshold and mobility of the driving transistor Td in each pixel circuit 10. In particular, divided threshold correction is carried out in this circuit operation. Specifically, the threshold correction operation is carried out plural times in a divided manner in the period of one light-emission cycle.

The threshold correction operation and the mobility correction operation themselves in the pixel circuit operation are carried out also in the related art. A simple description will be made below about the necessity of them.

In the pixel circuit employing e.g. a poly-silicon TFT, the threshold voltage Vth of the driving transistor Td and the mobility p of the semiconductor thin film serving as the channel of the driving transistor Td often change over time. Furthermore, due to variation in the manufacturing process, the transistor characteristics such as the threshold voltage Vth and the mobility p differ from pixel to pixel.

If the threshold voltage and mobility of the driving transistor Td differ from pixel to pixel, variation arises in the value of the current flowing through the driving transistor Td on a pixel-by-pixel basis. Therefore, even if the same video signal value (video signal voltage Vsig) is given to all pixel circuits 10, variation on a pixel-by-pixel basis arises in the light emission luminance of the organic EL element 1. As a result, the uniformity (evenness) of the screen is deteriorated.

For this reason, the pixel circuit operation is endowed with the correction functions against variation in the threshold voltage Vth and the mobility p.

Figure 3:
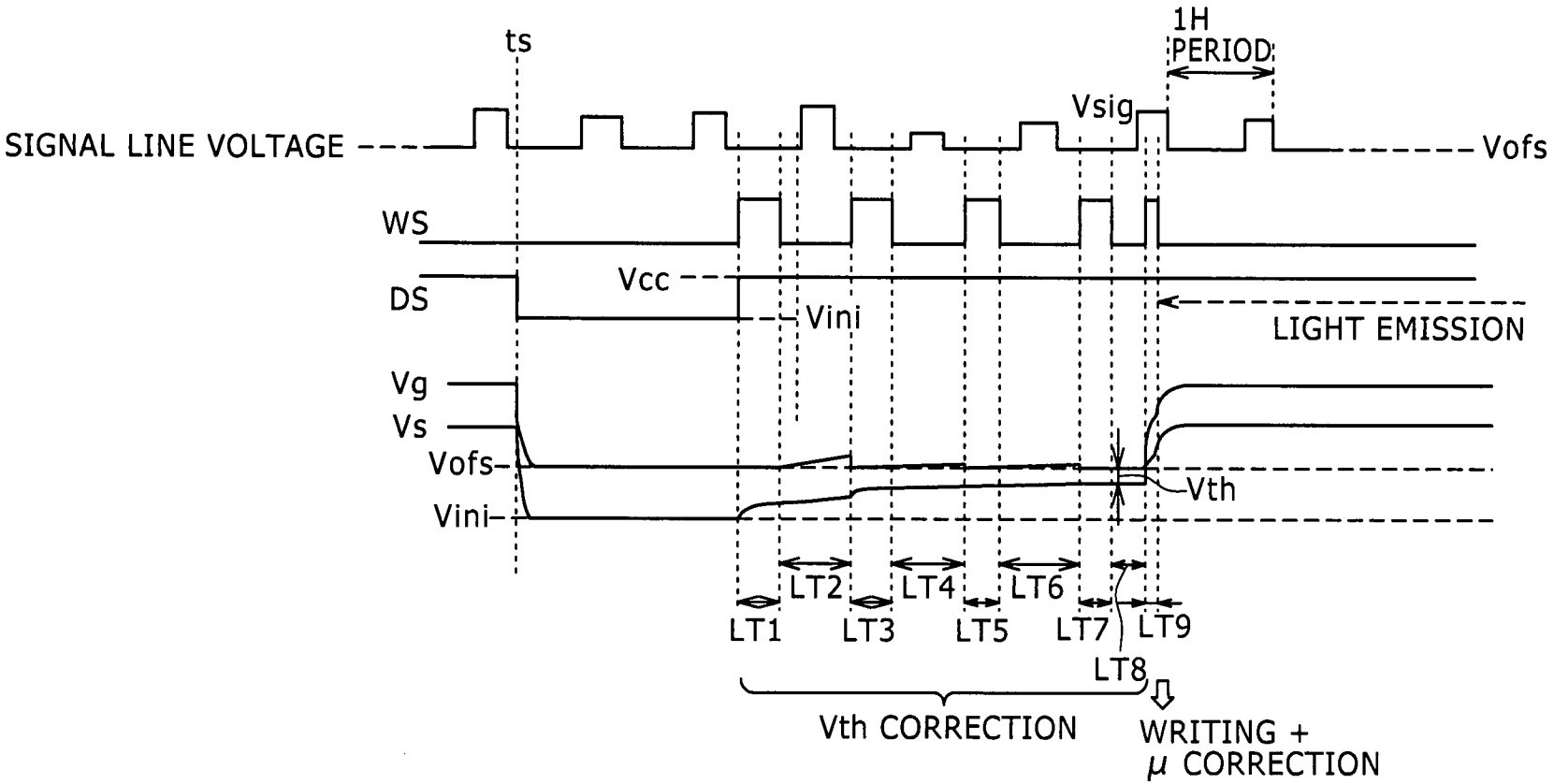
FIG. 3 is an explanatory diagram of pixel circuit operation when divided threshold correction is carried out.

FIG. 3 shows a timing chart of the operation of one cycle (one-frame period) of the pixel circuit 10.

In FIG. 3, the signal line voltage given to the signal line DTL by the horizontal selector 11 is shown. In this operation example, as the signal line voltage, the horizontal selector 11 supplies, to the signal line DTL, a pulse voltage as the threshold correction reference voltage Vofs and the video signal voltage Vsig in one horizontal period (1H).

Furthermore, FIG. 3 shows the scanning pulse WS given to the gate of the sampling transistor Ts by the write scanner 13 via the writing control line WSL. The re-channel sampling transistor Ts is turned on by switching of the scanning pulse WS to the H-level, and is turned off by switching of the scanning pulse WS to the L-level.

In addition, FIG. 3 shows the power supply pulse DS supplied from the drive scanner 12 via the power supply control line DSL. As the power supply pulse DS, the driving voltage Vcc or the initial voltage Vini is given.

Moreover, FIG. 3 shows changes in the gate voltage and source voltage of the driving transistor Td as a gate voltage Vg and a source voltage Vs.

A timing ts in the timing chart of FIG. 3 is the start timing of one cycle of the light emission driving of the organic EL element 1, which is a light emitting element, e.g. the start timing of the one-frame period of image displaying.

First, at the timing ts, the power supply pulse DS is set to the initial potential Vini, and the scanning pulse WS is switched to the H-level, which turns on the sampling transistor Ts.

The supply of the driving voltage Vcc is stopped due to the setting of the power supply pulse DS to the initial potential Vini. Thus, the gate voltage and source voltage of the driving transistor Td are lowered and the light emission of the organic EL element 1 is stopped, so that a non-light-emission period starts.

In this case, the source potential becomes Vini and the signal line voltage is given to the gate of the driving transistor Td via the sampling transistor Ts. At this time, because the signal line voltage is equal to the threshold correction reference voltage Vofs, the gate potential becomes Vofs.

The initial potential Vini is so designed as to satisfy a relationship of Vofs−Vini>Vth. Vth is the threshold voltage of the driving transistor Td.

That is, as preparation for the threshold correction, the gate-source voltage of the driving transistor is set sufficiently higher than the threshold voltage Vth of the driving transistor.

Subsequently, the first round of threshold correction (Vth correction) is carried out as a period LT1.

In this case, at the timing when the signal line voltage is set to the threshold correction reference voltage Vofs, the write scanner 13 switches the scanning pulse WS to the H-level, and simultaneously the drive scanner 12 switches the power supply pulse DS to the driving voltage Vcc.

Thereupon, the source node potential of the driving transistor Td rises, with the gate potential thereof fixed at the threshold correction reference voltage Vofs.

This is because a current flows from the power supply control line DSL toward the anode of the organic EL element 1 due to the switching of the power supply pulse DS to the driving voltage Vcc. As long as the anode potential Vel of the organic EL element 1 satisfies a relationship of Vel≤VCat+Vthel (threshold voltage of the organic EL element 1), the current of the driving transistor Td is used to charge the hold capacitor Cs and the capacitor Coled. Satisfying Vel≤Vcat+Vthel means that the leakage current of the organic EL element 1 is considerably smaller than the current flowing through the driving transistor Td.

Therefore, the anode potential Vel (source potential of the driving transistor Td) rises over time.

This threshold correction can be regarded as operation to equalize the gate-source voltage of the driving transistor Td to the threshold voltage Vth. Therefore, the source potential of the driving transistor Td rises until the gate-source voltage of the driving transistor Td becomes the threshold voltage Vth.

However, the period during which the gate node potential can be fixed at the threshold correction reference voltage Vofs is only the period when the signal line voltage is Vofs. Thus, a sufficient time of one round of the threshold correction operation to allow the source potential to rise until the gate-source voltage reaches the threshold voltage Vth can not be ensured depending on the frame rate and so forth. Therefore, the threshold correction is carried out plural times in a divided manner.

For this purpose, before the signal line voltage is switched to the video signal voltage Vsig, a period LT2 is started to take a pause in the threshold correction. Specifically, the write scanner 13 temporarily switches the scanning pulse WS to the L-level to turn off the sampling transistor Ts.

At this time, both the gate and source are in the floating state. Therefore, a current flows between the drain and source depending on the gate-source voltage Vgs and bootstrap operation is carried out. That is, the gate potential and the source potential rise as shown in the diagram.

Next, the second round of threshold correction is carried out as a period LT3. Specifically, when the signal line voltage is the threshold correction reference voltage Vofs, the write scanner 13 switches the scanning pulse WS to the H-level again to turn on the sampling transistor Ts. Due to this operation, the gate voltage of the driving transistor Td is set to the threshold correction reference voltage Vofs, and the source potential rises again.

Subsequently, a pause in the threshold correction operation is taken in a period LT4. Because the gate-source voltage of the driving transistor Td has been brought closer to the threshold voltage Vth by the second round of threshold correction, the amount of bootstrap in the second round of pause period is smaller than that in the first round of pause period.

Subsequently, the third round of threshold correction is carried out in a period LT5, and then through a pause in a period LT6, the fourth round of threshold correction is carried out in a period LT7.

Finally, the gate-source voltage of the driving transistor Td becomes the threshold voltage Vth.

At this time, the source potential (anode potential Vel of the organic EL element 1) is equal to Vofs−Vth≤Vcat+Vthel (Vcat is the cathode potential and Vthel is the threshold voltage of the organic EL element 1).

In the case of FIG. 3, after the period LT7 for the fourth round of threshold correction, the scanning pulse WS is switched to the L-level to turn off the sampling transistor Ts, so that the threshold correction operation is completed.

Although four times of threshold correction are carried out in this operation example, how many times the threshold correction operation is carried out in a divided manner is properly decided depending on the configuration and operation of the display device. In other operation examples, the number of times of the divided threshold correction is two, three, five, or more.

Thereafter, through a period LT8, in a period LT9 during which the signal line voltage is the video signal voltage Vsig, the write scanner 13 switches the scanning pulse WS to the H-level, so that writing of the video signal voltage Vsig and mobility correction are carried out. That is, the video signal voltage Vsig is input to the gate of the driving transistor Td.

The gate potential of the driving transistor Td becomes equal to the video signal voltage Vsig. Due to the setting of the power supply control line DSL to the driving voltage Vcc, a current flows and the source potential rises over time.

At this time, unless the source voltage of the driving transistor Td surpasses the sum of the threshold voltage Vthel of the organic EL element 1 and the cathode voltage Vcat, the current of the driving transistor Td is used to charge the hold capacitor Cs and the capacitor Coled. That is, this is on condition that the leakage current of the organic EL element 1 is considerably smaller than the current flowing through the driving transistor Td.

Furthermore, at this timing, the current flowing through the driving transistor Td reflects the mobility p because the threshold correction operation for the driving transistor Td has been completed.

Specifically, in the driving transistor Td having high mobility, the amount of current at this time is large and the rise of the source potential is also fast. In contrast, in the driving transistor Td having low mobility, the amount of current is small and the rise of the source potential is slow.

Because of this feature, the gate-source voltage Vgs of the driving transistor Td decreases in such a manner as to reflect the mobility thereof, and becomes the voltage that completely corrects the mobility after the elapse of a certain time.

After the writing of the video signal voltage Vsig and the mobility correction are carried out in this manner, the gate-source voltage Vgs is settled, followed by transition to bootstrap and the light-emission state.

As just described, in the pixel circuit 10, as one cycle of the light emission driving operation in the one-frame period, operation for the light emission of the organic EL element 1 is carried out, including the threshold correction operation and the mobility correction operation.

By the threshold correction operation, the current dependent on the signal potential Vsig can be given to the organic EL element 1 irrespective of variation in the threshold voltage Vth of the driving transistor Td among the respective pixel circuits 10, change in the threshold voltage Vth over time, and so forth. That is, variation in the threshold voltage Vth due to variation in the manufacturing or change over time can be cancelled, and the high image quality can be maintained without the occurrence of luminance unevenness and so forth on the screen.

The drain current varies also depending on the mobility of the driving transistor Td, and therefore the image quality is lowered due to variation in the mobility of the driving transistor Td from pixel circuit 10 to pixel circuit 10. However, by the mobility correction, the source potential Vs is obtained depending on the magnitude of the mobility of the driving transistor Td. As a result, the gate-source voltage Vgs is adjusted to such a voltage as to absorb variation in the mobility of the driving transistor Td from pixel circuit 10 to pixel circuit 10, and thus the image quality lowering due to the variation in the mobility is also eliminated.

The reason why the threshold correction operation is carried out plural times in a divided manner in one cycle of the pixel circuit operation is the request for enhancement in the frequency of the display device.

Along with increase in the frame rate, the operating time of the pixel circuit is relatively shortened, which makes it difficult to ensure a continuous threshold correction period (period during which the signal line voltage is the threshold correction reference voltage Vofs). To address this problem, the threshold correction operation is carried out in a time-division manner to thereby ensure the necessary period as the threshold correction period so that the gate-source voltage of the driving transistor Td may converge on the threshold voltage Vth.

[3. Pixel Circuit Operation Considered in Process of Reaching the Present Invention: STC Driving]

However, if the frame rate increase is further advanced, a larger number of times of the divided threshold correction are needed to ensure the threshold correction operation period.

As a driving system to allow more proper ensuring of the threshold correction time, the STC driving system has been developed.

The operation of the STC driving system will be described below.

In this case, as described above with FIG. 1, for example three horizontal lines are grouped into one unit, and light emission driving including the threshold correction operation is carried out on a unit-by-unit basis.

Figure 4:
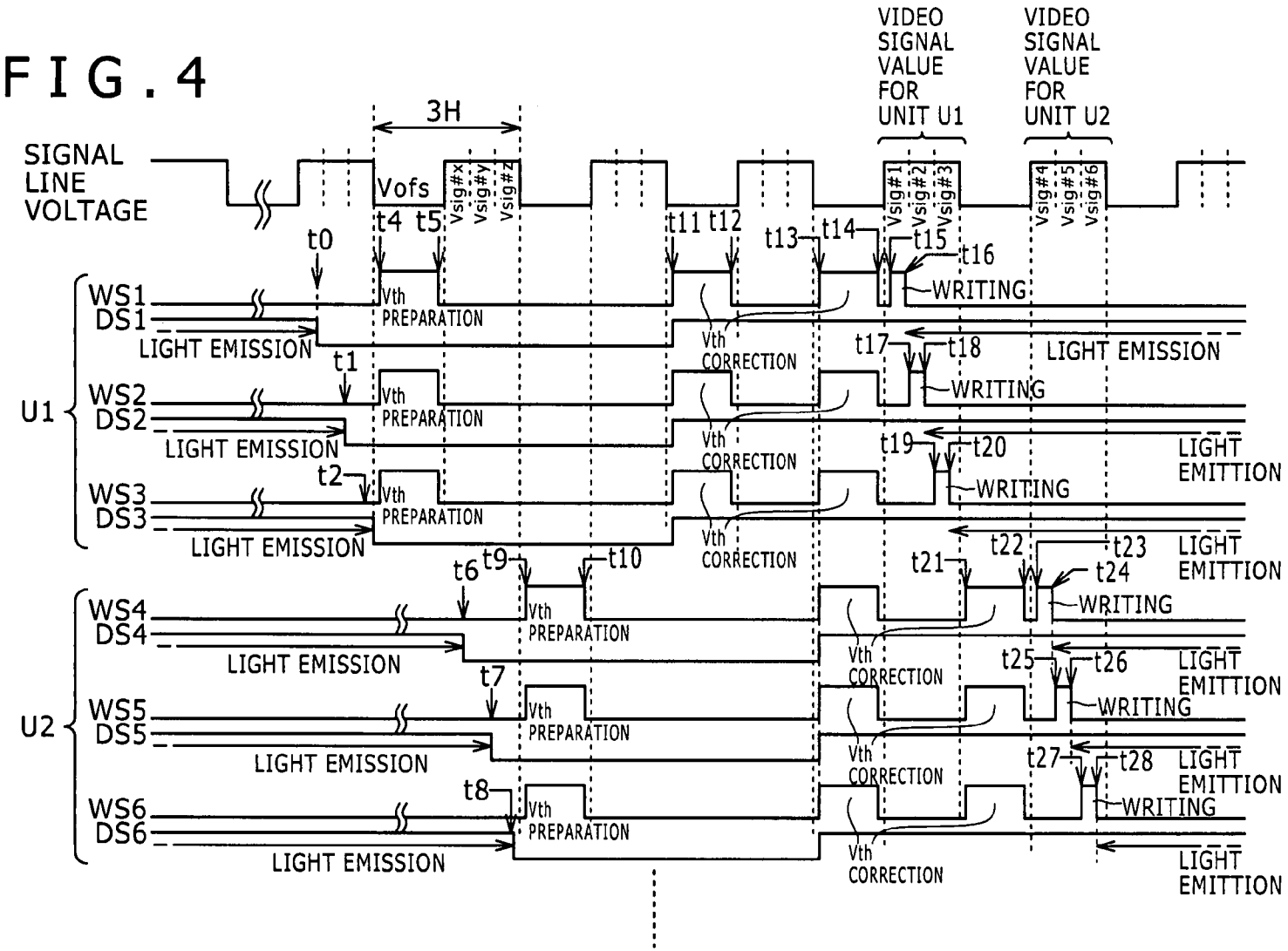
FIG. 4 is an explanatory diagram of pixel circuit operation when STC driving is carried out.

FIG. 4 shows the signal line voltage, the scanning pulse WS, and the power supply pulse DS when the STC driving system is employed.

In FIG. 4, the following pulses are shown regarding the unit U1: the scanning pulse WS1 and the power supply pulse DS1 for the pixels on the first line in FIG. 1; the scanning pulse WS2 and the power supply pulse DS2 for the pixels on the second line; and the scanning pulse WS3 and the power supply pulse DS3 for the pixels on the third line.

Furthermore, the following pulses are shown regarding the unit U2: the scanning pulse WS4 and the power supply pulse DS4 for the pixels on the fourth line, which is not shown in FIG. 1; the scanning pulse WS5 and the power supply pulse DS5 for the pixels on the fifth line; and the scanning pulse WS6 and the power supply pulse DS6 for the pixels on the sixth line.

As the signal line voltage given to the signal line DTL by the horizontal selector 11, the threshold correction reference voltage Vofs and pulse voltages as three video signal voltages Vsig#x, Vsig#y, and Vsig#z are given in three horizontal periods (3H).

The 3H period is the period designed in association with the grouping of three horizontal lines into one unit.

For example, the video signal voltages Vsig given to the respective pixel circuits 10 of the unit U1 (first line to third line) by one signal line DTL are shown as Vsig#1, Vsig#2, and Vsig#3. Furthermore, the video signal voltages Vsig given to the respective pixel circuits 10 of the unit U2 (fourth line to sixth line) are shown as Vsig#4, Vsig#5, and Vsig#6.

The operation of FIG. 4 is based on the assumption that the video signal voltage Vsig is so given that all pixels on the screen emit light with the same luminance, and thus a relationship of Vsig#1=Vsig#2=Vsig#3=Vsig#4=Vsig#5=Vsig#6 . . . Vsig#x=Vsig#y=Vsig#z is satisfied. Of course, in normal video displaying, each video signal voltage Vsig has the voltage value corresponding to the luminance of the light emission of the corresponding pixel circuit 10.

The horizontal selector 11 gives the threshold correction reference voltage Vofs and the video signal voltages Vsig#1, Vsig#2, and Vsig#3 to the signal line DTL in a certain 3H period (period in which the video signal voltage Vsig for the unit U1 is output).

In the next 3H period, which is the period in which the video signal voltage Vsig for the unit U2 is output, the horizontal selector 11 gives the threshold correction reference voltage Vofs and the video signal voltages Vsig#4, Vsig#5, and Vsig#6 to the signal line DTL.

In this STC driving system, the write scanner 13 outputs the scanning pulse WS in such a way that threshold correction operation is simultaneously carried out for the respective pixel circuits in one unit in the period of one light-emission cycle of the respective pixel circuits. That is, the write scanner 13 outputs the scanning pulse WS in such a way that the threshold correction reference voltage Vofs is simultaneously input to the respective pixel circuits.

The driving of the pixel circuits 10 on the respective lines by the scanning pulse WS and the power supply pulse DS is as follows.

For the pixel circuit 10 of the first line, at a timing t0, the power supply pulse DS1 is switched to the initial potential Vini, so that the light emission of the previous frame is ended and one cycle of light emission operation of the present frame is started.

For the pixel circuit 10 of the second line, at a timing t1, the power supply pulse DS2 is switched to the initial potential Vini, so that the light emission of the previous frame is ended and one cycle of light emission operation of the present frame is started.

For the pixel circuit 10 of the third line, at a timing t2, the power supply pulse DS3 is switched to the initial potential Vini, so that the light emission of the previous frame is ended and one cycle of light emission operation of the present frame is started.

The reason why the light-emission end timings of the respective pixels of the unit U1 are the timings t0, t1, and t2 different from each other is that the light-emission start timings as timings t16, t18, and t20 to be described later are different from each other. This is for the purpose of equalizing the light-emission period lengths of the pixel circuits 10 of the respective lines to each other so that the occurrence of visually-recognizable luminance difference may be prevented.

After the turning of the respective pixels of the unit U1 to the non-light-emission state at the timings to, t1, and t2, at first, threshold correction preparation is simultaneously carried out in the period from a timing t4 to a timing t5.

Specifically, in the period when the signal line voltage is the threshold correction reference voltage Vofs, the scanning pulses WS1, WS2, and WS3 are simultaneously set to the H-level.

Thereby, the gate voltage Vg of the driving transistor in each of the pixel circuits 10 of the first to third lines is set to the threshold correction reference voltage Vofs. The source potential is equal to Vini.

The initial potential Vini is so designed as to satisfy a relationship of Vofs−Vini>Vth. Thus, as preparation for the threshold correction, the gate-source voltage of the driving transistor is set sufficiently higher than the threshold voltage Vth of the driving transistor.

Next, in the period from a timing t11 to a timing t12, the first round of threshold correction is simultaneously carried out in the respective pixel circuits 10 of the first to third lines.

Specifically, in the period when the signal line voltage is the threshold correction reference voltage Vofs, the scanning pulses WS1, WS2, and WS3 are simultaneously set to the H-level, and the power supply pulses DS1, DS2, and DS3 are simultaneously set to the driving voltage Vcc.

Due to this operation, in the respective pixel circuits 10 of the first to third lines, the source node potential of the driving transistor Td rises, with the gate potential thereof fixed at the threshold correction reference voltage Vofs. That is, the gate-source voltage Vgs comes closer to the threshold voltage Vth.

The first round of threshold correction operation is ended by simultaneous switching of the scanning pulses WS1, WS2, and WS3 to the L-level, and a pause in the threshold correction is taken during the period in which the signal line voltage is set to the video signal voltage Vsig.

Subsequently, in the period from a timing t13 to a timing t14, the second round of threshold correction is carried out simultaneously in the respective pixel circuits 10 of the first to third lines.

Specifically, in the period when the signal line voltage is the threshold correction reference voltage Vofs, the scanning pulses WS1, WS2, and WS3 are simultaneously set to the H-level, so that the second round of threshold correction operation is carried out.

In this example, two times of the threshold correction operation are carried out in a divided manner. By the second round of threshold correction operation, the gate-source voltage Vgs of the driving transistor Td becomes the threshold voltage Vth, and the threshold correction operation is completed.

Subsequently, writing of the video signal voltage Vsig is sequentially performed.

First, writing to the pixel circuits 10 of the first line is performed in the period from a timing t15 to the timing t16, during which the video signal voltage Vsig#1 is given as the signal line voltage by the horizontal selector 11. That is, the scanning pulse WS1 is set to the H-level in the period from the timing t15 to the timing t16.

Thereby, in the respective pixel circuits 10 of the first line, the video signal voltage Vsig#1 is written to the gate of the driving transistor Td. In addition, a current flows because the power supply control line DSL is set to the driving voltage Vcc, and the source potential rises over time, so that mobility correction is carried out.

The writing of the video signal voltage Vsig#1 and the mobility correction are carried out in this manner, and the gate-source voltage Vgs is settled, followed by transition to the light-emission state after the timing t16.

Furthermore, in the period from a timing t17 to the timing t18, during which the video signal voltage Vsig#2 is given as the signal line voltage by the horizontal selector 11, the scanning pulse WS2 is set to the H-level and writing to the pixel circuits 10 of the second line is performed. That is, in the respective pixel circuits 10 of the second line, the video signal voltage Vsig#2 is written to the gate of the driving transistor Td, and mobility correction is carried out, followed by transition to the light-emission state after the timing t18.

Moreover, in the period from a timing t19 to the timing t20, during which the video signal voltage Vsig#3 is given as the signal line voltage by the horizontal selector 11, the scanning pulse WS3 is set to the H-level and writing to the pixel circuits 10 of the third line is performed. In the respective pixel circuits 10 of the third line, the video signal voltage Vsig#3 is written to the gate of the driving transistor Td, and mobility correction is carried out, followed by transition to the light-emission state after the timing t20.

One cycle of the light emission operation of the respective pixel circuits of the unit U1 is as described above.

In the unit U2, for the respective pixel circuits 10 of the fourth to sixth lines, similar operation is carried out with the shift of the operating period from that of the unit U1 by the 3H period.

Specifically, at timings t6, t7, and t8, the power supply pulses DS4, DS5, and DS6 are switched to the initial potential Vini, so that the light emission of the previous frame is sequentially ended in the respective pixel circuits 10 of the fourth to sixth lines and one cycle of the light emission operation of the present frame is started.

In the period from a timing t9 to a timing t10, the scanning pulses WS4, WS5, and WS6 are simultaneously set to the H-level, and the threshold correction preparation is simultaneously carried out in the respective pixel circuits 10 of the fourth to sixth lines. Thereby, the gate voltage Vg of the driving transistor in each of the pixel circuits 10 of the fourth to sixth lines is set to the threshold correction reference voltage Vofs. The source potential is equal to Vini. That is, the gate-source voltage of each driving transistor is set sufficiently higher than the threshold voltage Vth of the driving transistor.

Next, in the period from the timing t13 to the timing t14, the scanning pulses WS4, WS5, and WS6 are simultaneously set to the H-level, and the power supply pulses DS4, DS5, and DS6 are simultaneously set to the driving voltage Vcc. Due to this operation, the first round of threshold correction is simultaneously carried out in the respective pixel circuits 10 of the fourth to sixth lines.

Furthermore, after a correction pause period, in the period from a timing t21 to a timing t22, the scanning pulses WS4, WS5, and WS6 are simultaneously set to the H-level, so that the second round of threshold correction is simultaneously carried out in the respective pixel circuits 10 of the fourth to sixth lines.

Subsequently, writing of the video signal voltages Vsig#4, Vsig#5, and Vsig#6 is sequentially performed.

First, in the period from a timing t23 to a timing t24, during which the signal line voltage is the video signal voltage Vsig#4, the scanning pulse WS4 is set to the H-level, and writing of the video signal voltage Vsig#4 to the pixel circuits 10 of the fourth line and mobility correction are carried out, followed by transition to the light-emission state after the timing t24.

Furthermore, in the period from a timing t25 to a timing t26, during which the signal line voltage is the video signal voltage Vsig#5, the scanning pulse WS5 is set to the H-level, and writing of the video signal voltage Vsig#5 to the pixel circuits 10 of the fifth line and mobility correction are carried out, followed by transition to the light-emission state after the timing t26.

In addition, in the period from a timing t27 to a timing t28, during which the signal line voltage is the video signal voltage Vsig#6, the scanning pulse WS6 is set to the H-level, and writing of the video signal voltage Vsig#6 to the pixel circuits 10 of the sixth line and mobility correction are carried out, followed by transition to the light-emission state after the timing t28.

In the STC driving system, the threshold correction operation and so forth is collectively carried out on a unit-by-unit basis in this manner.

The collective threshold correction operation for three lines makes it possible to use the 3H period for one operation in which the signal line voltage is set to the threshold correction reference voltage Vofs/video signal voltage Vsig. That is, a long time can be ensured as the time for the threshold correction operation, and thus this driving method is effective to increase the operation margin even when the pulse transient is increased in linkage with enhancement in the frame rate and enlargement of the panel size.

Figure 5A:
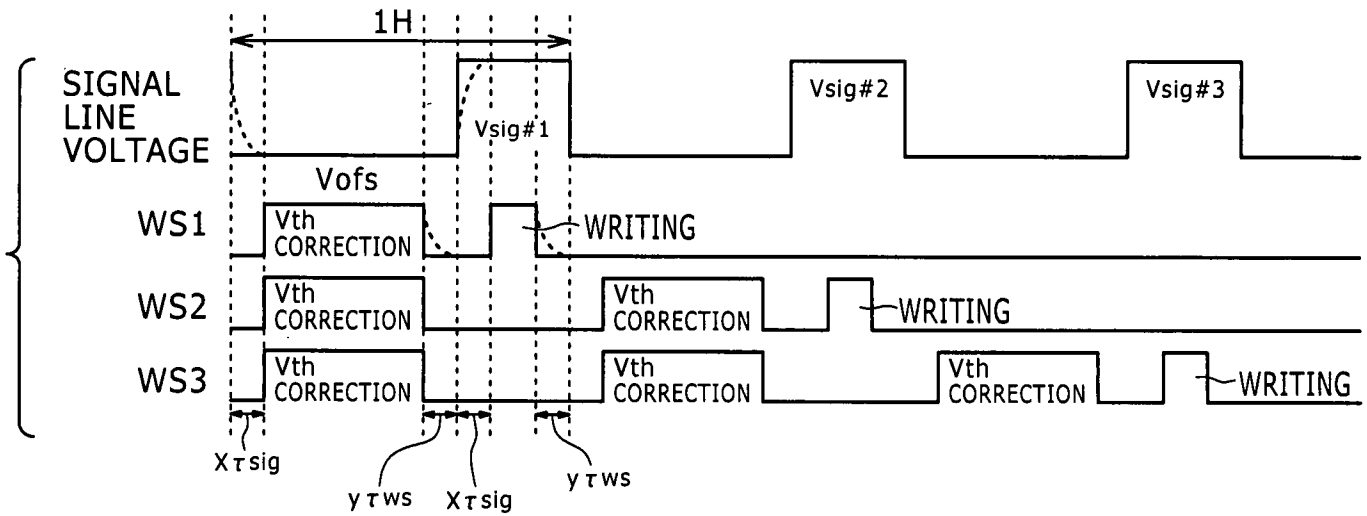
FIGS. 5A and 5B are explanatory diagrams of a threshold correction period in the STC driving.
Figure 5B:
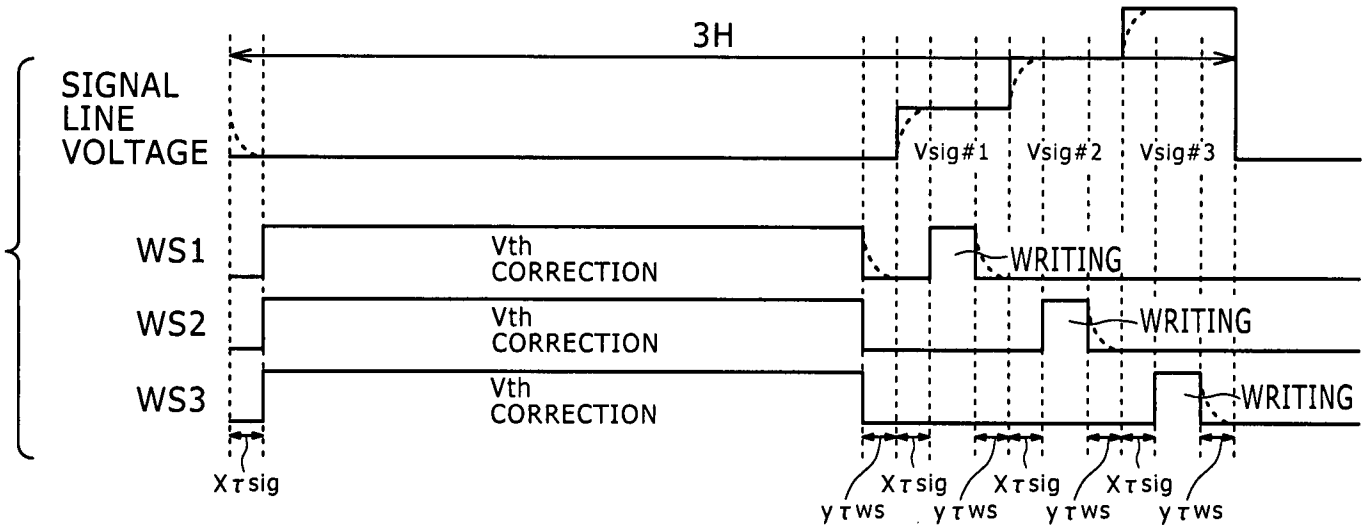

FIGS. 5A and 5B show the threshold correction times in the normal divided threshold correction (example of FIG. 3) and the STC driving.

As shown in FIG. 5A, in the divided threshold correction like that of FIG. 3, one time of the threshold correction operation is limited within the period during which the signal line voltage is set to the threshold correction reference voltage Vofs in the 1H period.

In contrast, in the above-described STC driving, as shown in FIG. 5B, a long period can be ensured as the period during which the signal line voltage is set to the threshold correction reference voltage Vofs because of the operation in units of the 3H period, and the period of one time of the threshold correction operation can be extended.

A more specific description will be made below. The necessary times other than the threshold correction time and the video signal writing time are the transient time of the signal line voltage pulse (xτsig) and the transient time of the scanning pulse WS (yτws).

In the normal operation of FIG. 5A, the total of these times is 2(xτsig+yτws). The total for three lines is 6(xτsig+yτws).

In the STC driving system with the three-line units, the total of the transient times is 4(xτsig+yτws) as shown in FIG. 5B. That is, the time margin of the threshold correction can be increased by 2(xτsig+yτws).

From the above description, if the STC driving system with X-line units is employed, the time margin is increased by (X−1) (xτsig+yτws) from that of the normal driving.

Therefore, it can be concluded that the STC driving is a driving method effective to increase the operation margin even when the pulse transient is increased in linkage with enhancement in the frame rate and enlargement of the panel size.

As just described, the STC driving system is advantageous in the case of attempting to increase the frame rate and the panel size because a long period can be ensured as the threshold correction operation period.

However, the STC driving will involve the following problem.

A consideration will be made about the waiting time from the end of the last threshold correction to the signal writing. For example, in the case of the unit U1 in FIG. 4, the second round of threshold correction operation from the timing t13 to the timing t14 is the last threshold correction, and the waiting time is from the end timing t14 of the last threshold correction to the writing of the video signal voltages Vsig1, Vsig2, and Vsig3.

Figure 6:
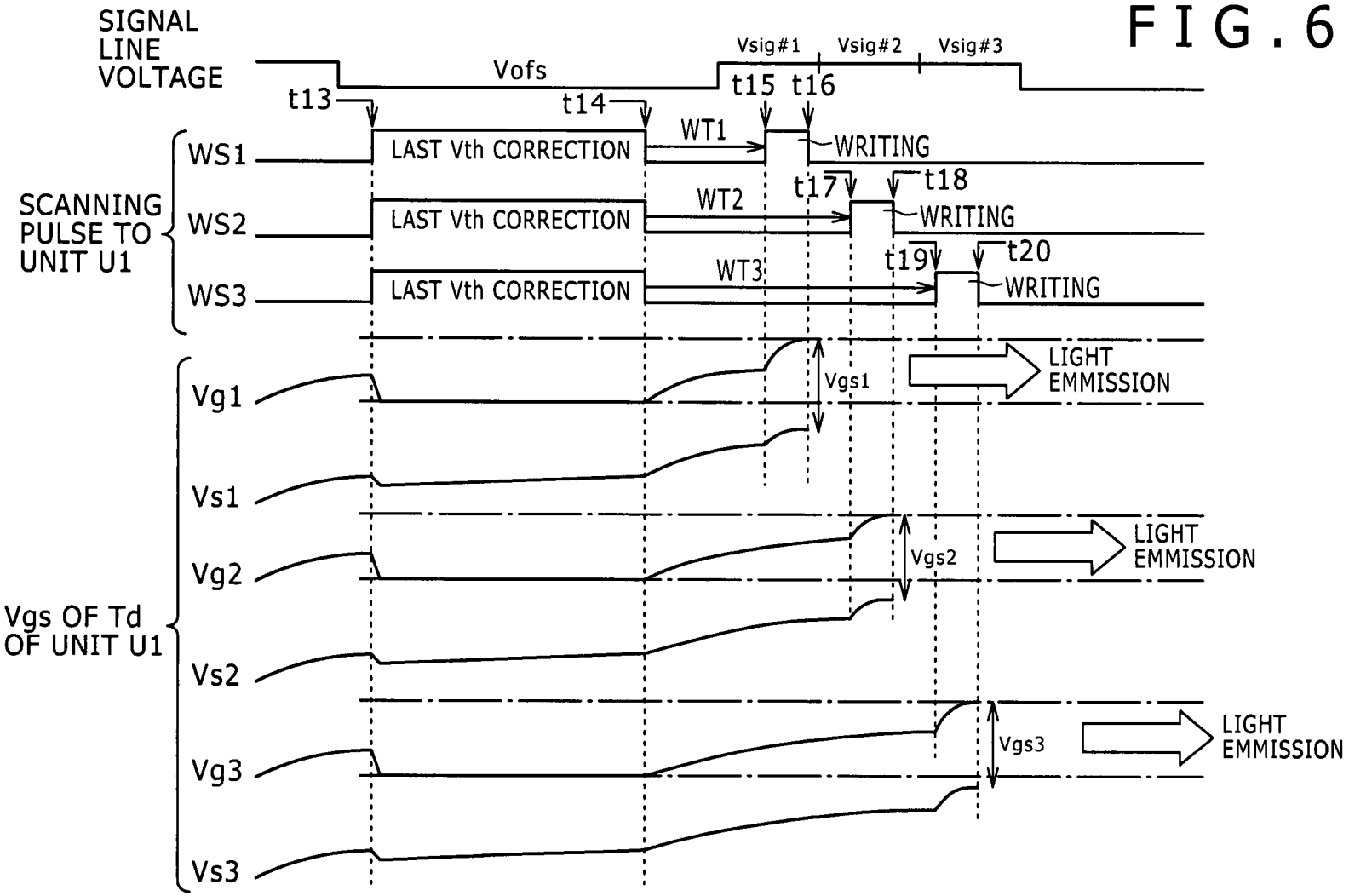
FIG. 6 is an explanatory diagram of variation in the gate-source voltage due to leakage in the STC driving.

In FIG. 6, the period from the last threshold correction to the signal writing in this unit U1 is shown in an enlarged manner, and the gate voltage and source voltage of the driving transistor Td in the pixel circuits 10 of the respective lines are shown.

Vg1 and Vs1 are the gate voltage and source voltage of the driving transistor Td in the pixel circuit 10 of the first line.

Vg2 and Vs2 are the gate voltage and source voltage of the driving transistor Td in the pixel circuit 10 of the second line.

Vg3 and Vs3 are the gate voltage and source voltage of the driving transistor Td in the pixel circuit 10 of the third line.

The gate-source voltages of the driving transistors Td in the pixel circuits 10 of the respective lines are shown as Vgs1, Vgs2, and Vgs3.

After the last threshold correction from the timing t13 to the timing 14, the gate-source voltage Vgs is nearly equal to Vth in the driving transistors Td of the respective lines.

Although the threshold correction has been completed and the relationship of Vgs Vth is obtained, a minute leakage current continues to flow between the drain and source of the driving transistor Td (generally the current Ids after the threshold correction is nearly equal to 1 pA).

In the same unit, the waiting time WT from the threshold correction end to the video signal writing differs from line to line.

Specifically, if the waiting times of the first, second, and third lines in the unit U1 are defined as WT1, WT2, and WT3, respectively, a relationship of WT1<WT2<WT3 holds.

The waiting time is longer in the line on the lower row. This means that the amount of rise of the source voltage Vs due to the leakage current of the driving transistor Td is also larger in the line on the lower row. Thus, the gate-source voltages Vgs in the same unit immediately before writing of the video signal voltage Vsig are in a relationship of Vgs1>Vgs2>Vgs3.

That is, in the line on the lower row, in which the waiting time WT is longer, the amount of rise of the source voltage Vs due to the leakage current is larger and thus the gate-source voltage Vgs becomes lower. This phenomenon yields difference in the gate-source voltage Vgs at the timing before writing of the video signal voltage Vsig.

Figure 7:
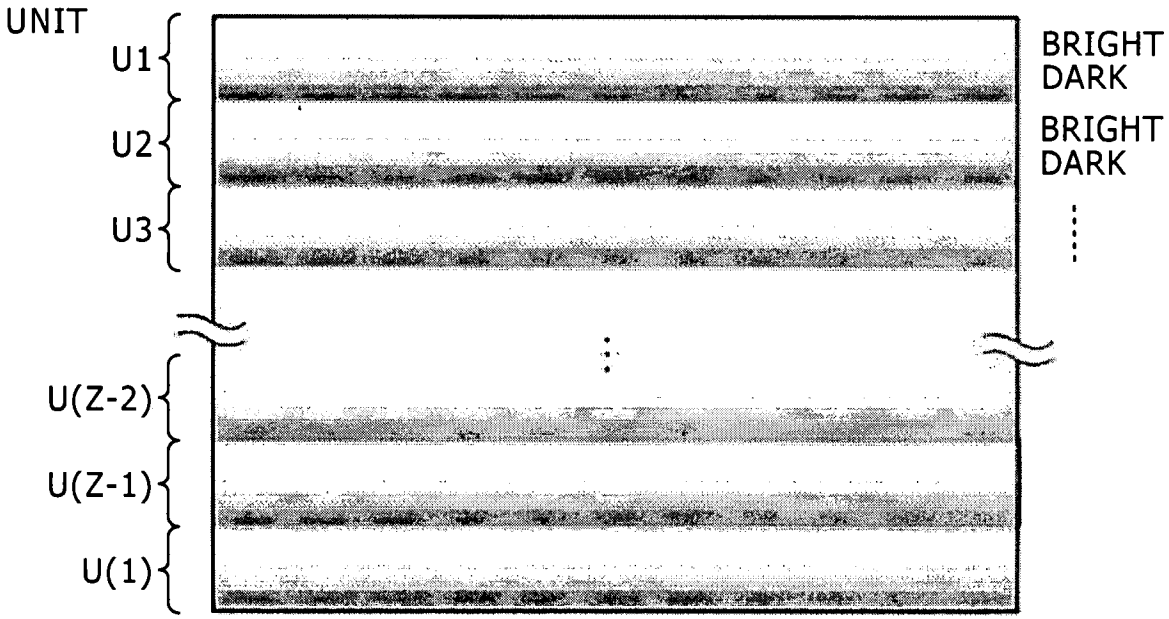
FIG. 7 is an explanatory diagram of streaks on the screen due to shading in the STC driving.

If thereafter the same video signal voltage (Vsig1=Vsig2=Vsig3) is written in the unit, shading in which the luminance is lower in the line on the lower row in the unit occurs as shown in FIG. 7. In raster displaying, this shading is visually recognized as a streak between different units.

[4. Pixel Circuit Operation of Embodiment]

The pixel circuit operation of the embodiment of the present invention employs the STC driving but prevents the appearance of streaks on the screen due to the above-described shading in the unit.

For this purpose, in the present embodiment, in a certain unit, the video signal voltage is written in the order from the beginning line to the end line in the unit. In the next unit, the video signal voltage is written in the reverse order from the end line to the beginning line in the unit. That is, the signal writing order is alternately inverted regarding the vertical direction between the even-numbered units and the odd-numbered units. Thereby, in a certain unit, the shading in the unit is in the direction of "bright" to "dark" along the downward direction. In contrast, in the next unit, the shading in the unit is in the direction of "dark" to "bright" along the downward direction. This shading direction inversion is repeated on a unit-by-unit basis. This eliminates the phenomenon in which the boundary between units is visually recognized as a streak.

Figure 8:
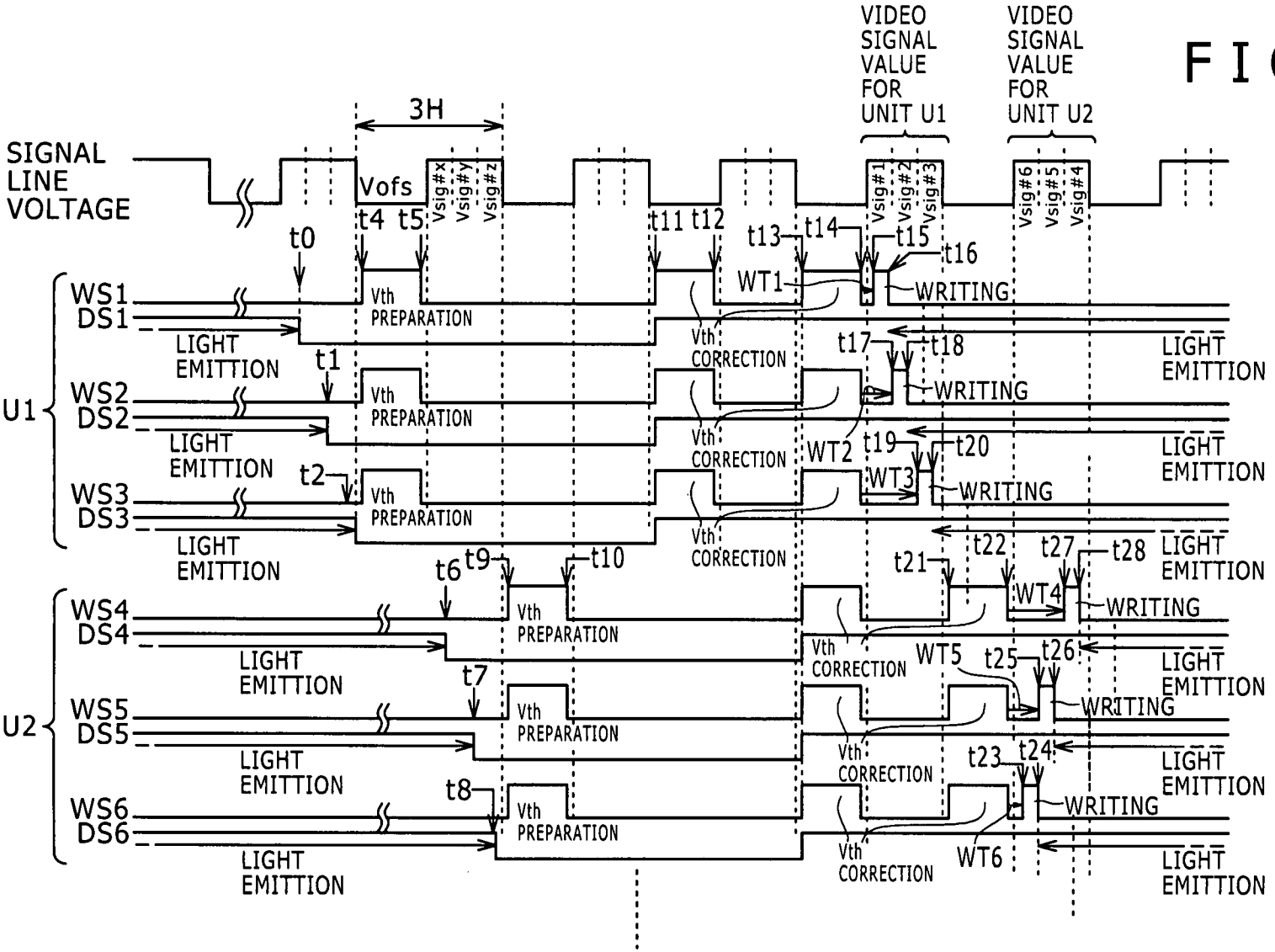
FIG. 8 is an explanatory diagram of the STC driving of the embodiment.

The pixel circuit operation of the embodiment will be described below with reference to FIG. 8. FIG. 8 shows, in the same format as that of FIG. 4, the signal line voltage and the respective scanning pulses WS (WS1 to WS6) and the respective power supply pulses DS (DS1 to DS6) about the units U1 and U2.

As the signal line voltage given to the signal line DTL by the horizontal selector 11, the threshold correction reference voltage Vofs and pulse voltages as three video signal voltages Vsig#x, Vsig#y, and Vsig#z are given in three horizontal periods (3H) similarly to the case of FIG. 4.

The drive scanner 12 supplies binary voltages as the power supply pulse DS, i.e. the driving voltage Vcc and the initial voltage Vini.

The driving of the pixel circuits 10 of the respective lines by the scanning pulse WS and the power supply pulse DS is as follows.

In the present embodiment, the order of writing of the video signal voltage Vsig in the respective lines in the unit is inverted between the odd-numbered units and the even-numbered units.

In this operation, in the units U1, U3, U5 . . . , the video signal voltage is written in the order from the beginning line to the end line in the unit. In the units U2, U4, U6 . . . , the video signal voltage is written in the reverse order from the end line to the beginning line in the unit.

The units U1 and U2 are shown in FIG. 8. In this operation, the driving of the unit U1 is the same as that in the operation of FIG. 4.

A redundant overlapping description about the threshold correction operation and so forth is avoided. The writing of the video signal voltage Vsig in the unit U1 is as follows.

In the period from a timing t15 to a timing t16, the video signal voltage Vsig#1 is given as the signal line voltage by the horizontal selector 11. In this period, the scanning pulse WS1 is set to the H-level, and writing of the video signal voltage Vsig#1 and mobility correction for the pixel circuits 10 of the first line are carried out, followed by transition to the light-emission state after the timing t16.

Furthermore, in the period from a timing t17 to a timing t18, the video signal voltage Vsig#2 is given as the signal line voltage by the horizontal selector 11. In this period, the scanning pulse WS2 is set to the H-level, and writing of the video signal voltage Vsig#2 and mobility correction for the pixel circuits 10 of the second line are carried out, followed by transition to the light-emission state after the timing t18.

Moreover, in the period from a timing t19 to a timing t20, the video signal voltage Vsig#3 is given as the signal line voltage by the horizontal selector 11. In this period, the scanning pulse WS3 is set to the H-level, and writing of the video signal voltage Vsig#3 and mobility correction for the pixel circuits 10 of the third line are carried out, followed by transition to the light-emission state after the timing t20.

The operation for the unit U2 is as follows. The threshold correction operation until a timing t22 is the same as that in the operation of FIG. 4.

In the period from a timing t23 to a timing t24, the video signal voltage Vsig#6 is given as the signal line voltage by the horizontal selector 11. In this period, the scanning pulse WS6 is set to the H-level, and writing of the video signal voltage Vsig#6 and mobility correction for the pixel circuits 10 of the sixth line are carried out, followed by transition to the light-emission state after the timing t24.

Furthermore, in the period from a timing t25 to a timing t26, the video signal voltage Vsig#5 is given as the signal line voltage by the horizontal selector 11. In this period, the scanning pulse WS5 is set to the H-level, and writing of the video signal voltage Vsig#5 and mobility correction for the pixel circuits 10 of the fifth line are carried out, followed by transition to the light-emission state after the timing t26.

Moreover, in the period from a timing t27 to a timing t28, the video signal voltage Vsig#4 is given as the signal line voltage by the horizontal selector 11. In this period, the scanning pulse WS4 is set to the H-level, and writing of the video signal voltage Vsig#4 and mobility correction for the pixel circuits 10 of the fourth line are carried out, followed by transition to the light-emission state after the timing t28.

Also for the unit U3 and the subsequent units (not shown), the writing order of the video signal voltage Vsig is alternately inverted like for the units U1 and U2.

Regarding the units U1 and U2, a consideration will be made about the writing time WT from the completion of the threshold correction operation to writing of the video signal voltage Vsig, described with FIG. 6.

In the unit U1, the waiting time is the shortest in the first line as the beginning line in the unit, and the waiting time is the longest in the third line as the end line in the unit (WT1<WT2<WT3). Therefore, the luminance of the beginning line side is the highest due to the influence of the leakage current described with FIG. 6.

In the unit U2, the waiting time is the longest in the fourth line as the beginning line in the unit, and the waiting time is the shortest in the sixth line as the end line in the unit (WT6<WT5<WT4). Therefore, the luminance of the beginning line side is the lowest due to the influence of the leakage current.

Figure 11:
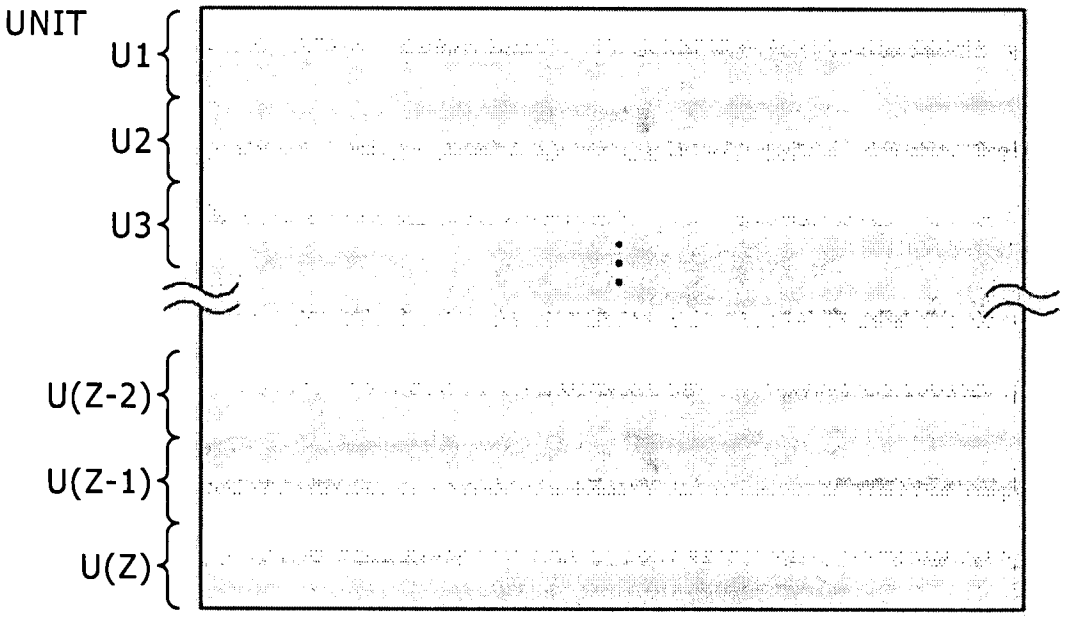
FIG. 11 is an explanatory diagram of the state in which streaks on the screen are eliminated in the embodiment.

Thus, although shading in each one unit occurs also in this case, the luminance difference attributed to the shading is in a moderate gradation state as the whole of the screen as shown in FIG. 11. FIG. 11 is so made that the contrast between dark and bright parts is highlighted for convenience of description.

Specifically, luminance difference hardly exists between the end line of a certain unit and the beginning line of the next unit, and a streak visually recognized at the boundary part between the units as shown in FIG. 7 is eliminated. In particular, in terms of vision, gradation like that in FIG. 11 looks an image with uniform luminance across almost the entire screen differently from the case in which streaks like those in FIG. 7 occur. That is, the quality of the screen visually recognized in displaying on the screen with the same luminance can be enhanced.

To realize such operation, the output order of the scanning pulse WS of the write scanner 13 and the output order of the video signal voltage Vsig by the horizontal selector 11 should be inverted on a unit-by-unit basis.

Figure 9:
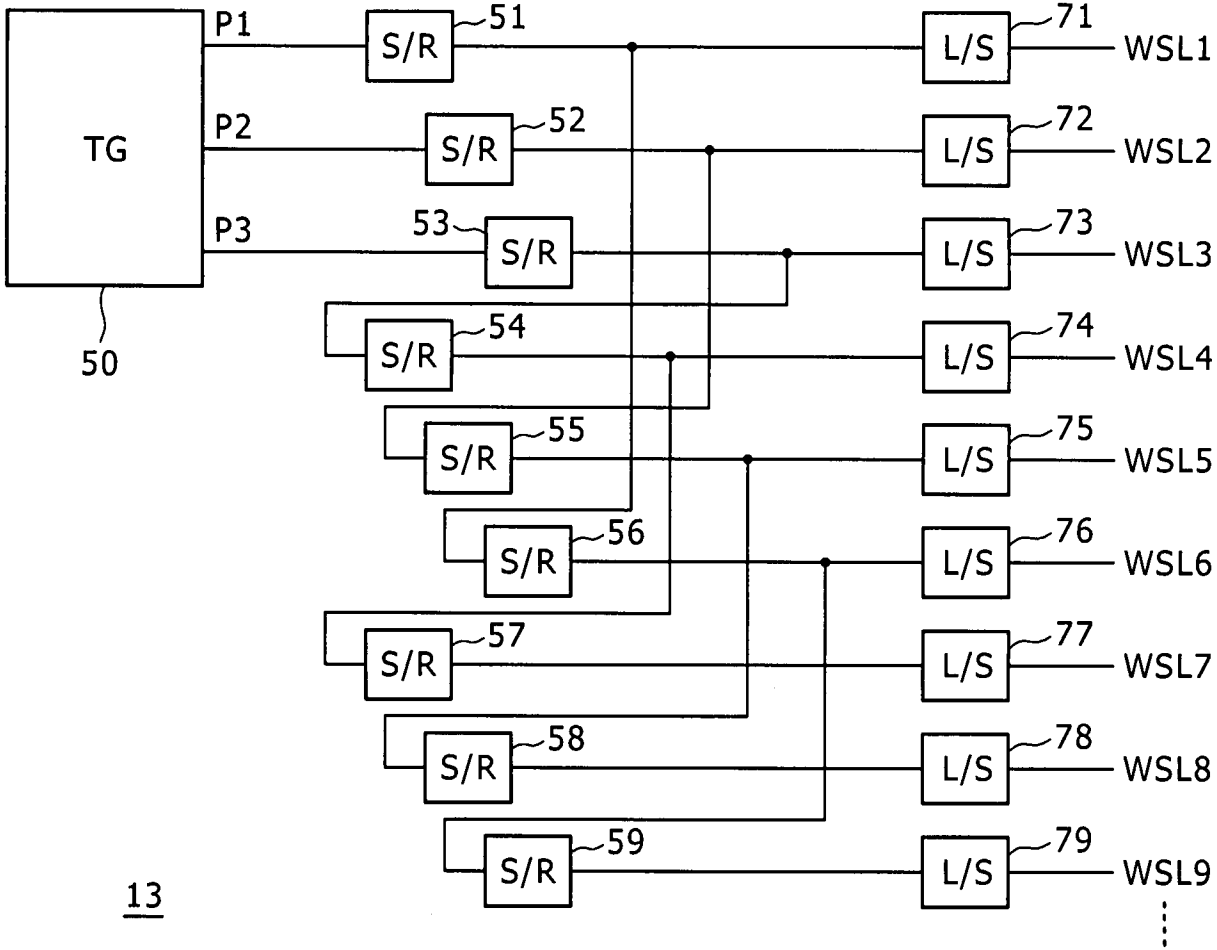
FIG. 9 is an explanatory diagram of a configuration example of a write scanner in the embodiment.
Figure 10:
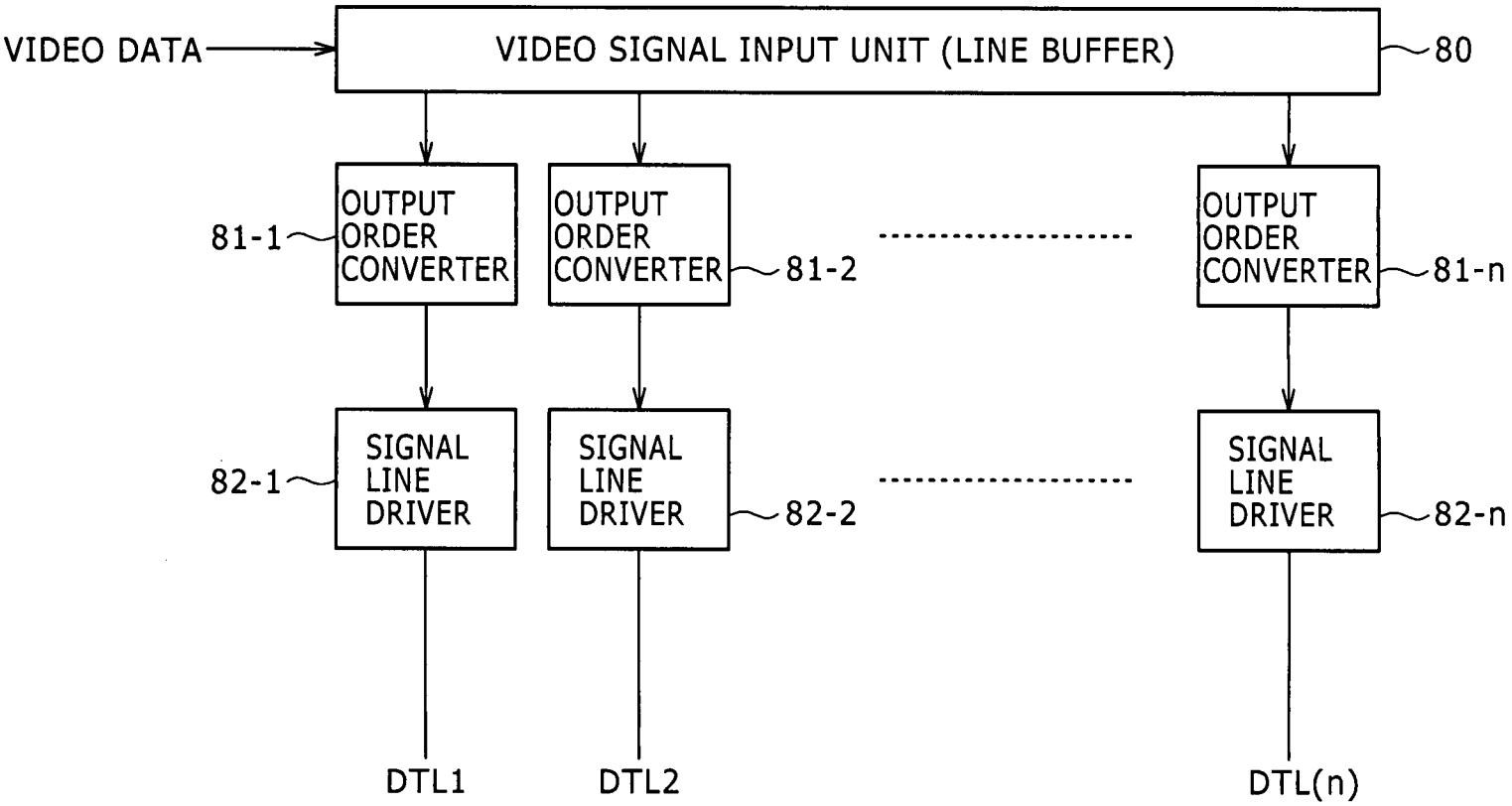
FIG. 10 is an explanatory diagram of a configuration example of a horizontal selector in the embodiment.

For this purpose, the write scanner 13 and the horizontal selector 11 employ configurations like those shown in FIG. 9 and FIG. 10, respectively.

FIG. 9 shows the configuration part for outputting the scanning pulse WS for writing of the video signal voltage Vsig (scanning pulse output path) in the write scanner.

A timing generator 50 outputs pulses P1, P2, and P3 at the respective predetermined timings. The pulses P1, P2, and P3 have the timing intervals and pulse widths corresponding to the scanning pulses of the timings t15, t17, and t19 in FIG. 8.

The pulses P1, P2, and P3 are supplied to shift registers 51, 52, and 53, respectively.

The shift registers 51 to 59 each delay the input pulse by the 3H period and output the delayed pulse.

The outputs of the shift registers 51, 52, and 53 are supplied to line drivers 71, 72, and 73 and the shift registers 56, 55, and 54.

The outputs of the shift registers 56, 55, and 54 are supplied to line drivers 76, 75, and 74 and the shift registers 59, 58, and 57.

The outputs of the shift registers 57, 58, and 59 are supplied to line drivers 77, 78, and 79 and three shift registers corresponding to the next unit (not shown).

The line drivers 71 to 79 output the scanning pulses WS1 to WS9 in response to the input pulse to the writing control lines WSL1 to WSL9, respectively.

In this configuration, when the pulses P1, P2, and P3 are input to the line drivers 71, 72, and 73 for the unit U1, the line drivers 71, 72, and 73 output, to the writing control lines WSL1, WSL2, and WSL3, the scanning pulses WS1, WS2, and WS3 of the timings t15, t17, and t19 in FIG. 8.

Furthermore, when the pulses P3, P2, and P1 from the shift registers 54, 55, and 56 are input to the line drivers 74, 75, and 76 for the unit U2, the line drivers 74, 75, and 76 output, to the writing control lines WSL4, WSL5, and WSL6, the scanning pulses WS4, WS5, and WS6 of the timings t27, t25, and t23 in FIG. 8. That is, in terms of the time, the shift registers output the pulses in the order of the scanning pulses WS6, WS5, and WS4.

In this manner, the signal transfer by the shift registers 51 to 59 (and the subsequent shift registers not shown) is so carried out that the order in the unit is reversed on a unit-by-unit basis regarding the scanning pulse WS for writing of the video signal voltage Vsig.

Due to this configuration, the order of the scanning pulse WS for writing of the video signal voltage Vsig is alternately reversed on a unit-by-unit basis.

In this FIG. 9, the path of outputting of the scanning pulse WS for threshold correction operation is not shown. In the outputting of the scanning pulse WS for threshold correction operation, the pulses P1, P2, and P3 are simultaneously output as pulses having the same pulse width from the timing generator 50. Furthermore, among the shift registers 51 to 59 (and the subsequent shift registers not shown), the transfer path is switched by a switch configuration (not shown), and pulses are transferred in the normal order with delay by every 3H period. The transfer path among the respective shift registers is so switched that for example the outputs of the shift registers 51, 52, and 53 are supplied to the shift registers 54, 55, and 56.

FIG. 10 shows a configuration example of the horizontal selector 11.

Video data is supplied from a video signal processing system (not shown) to a video signal input unit 80. The video signal input unit 80 functions as a line buffer and transfers the video data that should be given to the respective pixel circuits 10 to output order converters 81-1 to 81-n on each one horizontal line basis.

The output order converters 81-1 to 81-n change the video data order on a unit-by-unit basis and output the resulting data to signal line drivers 82-1 to 82-n.

For example, as to the output order converter 81-1, the video data (D#1 . . . D#m) for the pixel circuits 10 of the first column on the respective rows are sequentially supplied from the video signal input unit 80. The output order converter 81-1 includes e.g. a memory (or register) for at least six video data and temporarily stores the video data from the video signal input unit 80 in the memory. In readout of the video data, the output order converter 81-1 converts the data order.

Specifically, the output order converter 81-1 temporarily stores the video data supplied in the order of the video data D#1→D#2→D#3→D#4→D#5→D#6 . . . , and reads out and outputs the data in the order of D#1→D#2→D#3→D#6→D#5→D#4 . . . .

About the video data supplied in this order, the signal line driver 82-1 outputs the reference voltage Vofs and the video signal voltages Vsig corresponding to three video data D every 3H period.

For example in response to the input of the video data D#1, D#2, and D#3, the signal line driver 82-1 outputs the reference voltage Vofs and the video signal voltages Vsig#1, Vsig#2, and Vsig#3 in the 3H period.

Furthermore, in response to the input of the video data D#6, D#5, and D#4, the signal line driver 82-1 outputs the reference voltage Vofs and the video signal voltages Vsig#6, Vsig#5, and Vsig#4 in the next 3H period.

Due to the operation of the output order converters 81-1 to 81-n and the signal line drivers 82-1 to 82-n in the above-described manner, every 3H period, the video signal voltage Vsig is given to the respective signal lines DTL1 to DTL(n) with alternate reversal of the order of the video signal voltage Vsig on a unit-by-unit basis.

The above-described embodiment can eliminate streaks on the screen like those shown in FIG. 7 while achieving advantages in ensuring of the threshold correction period by the STC driving system.

This can provide a display driving system capable of properly responding to increases in the frame rate and the panel size.

Although the embodiment has been described above, the present invention is not limited to the above-described examples. For example, how many times the divided threshold correction is carried out in the STC driving is decided depending on the actual frame rate, panel size, and so forth. For example, the threshold correction is carried out three or more times in a divided manner in some cases.

Furthermore, the divided threshold correction does not necessarily have to be carried out as long as a sufficiently-long period can be ensured as the period of one time of threshold correction and the threshold correction can be completed by one time of threshold correction operation in all pixel circuits 10 in the unit.

In addition, grouping of three lines into one unit in the STC driving is one example, and it is also possible to carry out the STC driving with grouping of four or more lines into one unit. Also in this case, the writing order of the video signal voltage Vsig is reversed on a unit-by-unit basis.

Moreover, the present invention can be applied to not only the case in which difference in the gate-source voltage of the driving transistor arises due to a leakage current in the period from the end of threshold correction to writing of the video signal voltage Vsig like in the above-described example but also a pixel circuit that carries out such driving that difference in the gate-source voltage of the driving transistor arises due to a leakage current in the period from the first voltage setting by a predetermined reference voltage to writing of the video signal voltage Vsig.

The present application contains subject matter related to that disclosed in Japanese Priority Patent Application JP 2010-016352 filed in the Japan Patent Office on Jan. 28, 2010, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a pixel array including pixel circuits arranged in a matrix; and driving circuitry that is configured to drive the pixel circuits in units of N rows, where N is an integer greater than 1, such that for each of the units of N rows within a given frame period:

a reference voltage is simultaneously input in those of the pixel circuits that are included in the N rows of the unit, after input of the reference voltage, respective video signal voltages are input in a row-sequential writing order to each of the pixel circuits that are included in the N rows of the unit, and the writing order of the unit of N rows is different from the respective writing orders of any adjacent units of N rows.

2. The display device of claim 1, wherein each of the pixel circuits includes a light emitting element, a driving transistor configured to apply a current dependent on a gate-source voltage of the driving transistor to the light emitting element when a driving voltage is applied between a drain and a source of the driving transistor, a sampling transistor configured to control inputting of the reference voltage and the video signal voltage to a gate of the driving transistor, and a hold capacitor that is connected between the gate and source of the driving transistor, and the reference voltage is used for a threshold correction operation that, when performed for a given pixel circuit of the pixel circuits, causes a threshold voltage of the driving transistor of the given pixel circuit to be held in the holding capacitor of the given pixel circuit.

3. An electronic apparatus comprising the display device of claim 2.

4. The display device of claim 1, further comprising:

wherein the driving circuitry includes a signal selector that is configured to supply to signal lines, within each horizontal period, the reference voltage and then the respective video signal voltages for those of the pixel circuits that are included in the N rows of the unit that corresponds to the horizontal period, each horizontal period starting when supply of a corresponding instance of the reference voltage to the signal lines starts and ending when supply of a next instance of the reference voltage to the signal lines starts.

5. An electronic apparatus comprising the display device of claim 4.

6. The display device of claim 1, for each of the units, the writing order is either a first writing order of sequentially from a top line of the unit to a bottom line of the unit or a second writing order of sequentially from a bottom line of the unit to a top line of the unit.

7. An electronic apparatus comprising the display device of claim 6.

8. An electronic apparatus comprising the display device of claim 1.

9. A display device comprising a pixel array including pixel circuits arranged in a matrix; and driving circuitry that is configured to drive the pixel circuits in units of N rows, where N is an integer greater than 1, such that for each of the units of N rows within a given frame period:

a reference voltage is simultaneously input in those of the pixel circuits that are included in the N rows of the unit, after input of the reference voltage, respective video signal voltages are input in a row-sequential writing order to each of the pixel circuits that are included in the N rows of the unit, and the writing order of the unit of N rows is reverse from the respective writing orders of any adjacent units of N rows.

10. The display device of claim 9, wherein each of the pixel circuits includes a light emitting element, a driving transistor configured to apply a current dependent on a gate-source voltage of the driving transistor to the light emitting element when a driving voltage is applied between a drain and a source of the driving transistor, a sampling transistor configured to control inputting of the reference voltage and the video signal voltage to a gate of the driving transistor, and a hold capacitor that is connected between the gate and source of the driving transistor, and the reference voltage is used for a threshold correction operation that, when performed for a given pixel circuit of the pixel circuits, causes a threshold voltage of the driving transistor of the given pixel circuit to be held in the holding capacitor of the given pixel circuit.

11. The display device of claim 9, further comprising:

wherein the driving circuitry includes a signal selector that is configured to supply to signal lines, within each horizontal period, the reference voltage and then the respective video signal voltages for those of the pixel circuits that are included in the N rows of the unit that corresponds to the horizontal period, each horizontal period starting when supply of a corresponding instance of the reference voltage to the signal lines starts and ending when supply of a next instance of the reference voltage to the signal lines starts.

12. An electronic apparatus comprising the display device of claim 11.

13. The display device of claim 9, for each of the units, the writing order is either a first writing order of sequentially from a top line of the unit to a bottom line of the unit or a second writing order of sequentially from a bottom line of the unit to a top line of the unit.

14. An electronic apparatus comprising the display device of claim 9.

15. An electronic apparatus comprising the display device of claim 10.

16. A display device, comprising:

a pixel array including pixel circuits arranged in a matrix; and driving circuitry that is configured to drive the pixel circuits in drive units such that all of the pixel circuits that are in a same drive unit perform a threshold correction operation simultaneously, each drive unit comprising N rows of the pixel circuits, N being an integer greater than 1, wherein the driving circuitry is configured to drive the pixel circuits such that, for every pair comprising two of the drive units that are adjacent to one another, a duration of a waiting time increases row-sequentially within one drive unit of the respective pair and a duration of the waiting time decreases row-sequentially within the other drive unit in the respective pair, wherein the waiting time for each row is a time between an end of a last threshold correction operation for the respective row in the given frame period and a start of a video signal writing operation for the respective row in the given frame period.

17. The display device of claim 16, wherein the driving circuitry is configured to supply a reference voltage and video signal voltages to signal lines, each of the pixel circuits includes a light emitting element, a driving transistor configured to apply a current dependent on a gate-source voltage of the driving transistor to the light emitting element when a driving voltage is applied between a drain and a source of the driving transistor, a sampling transistor configured to control sampling a voltage of one of the signal lines to a gate of the driving transistor, and a hold capacitor that is connected between the gate and source of the driving transistor, and the threshold correction operation for each of the pixel circuits comprises inputting the reference voltage to the respective pixel circuit while the driving voltage is applied between the drain and the source of the driving transistor of the respective pixel circuit.

18. The display device of claim 17, wherein the driving circuitry includes a signal selector that is configured to supply to each of the signal lines, within each horizontal driving period, the reference voltage and then N of the video signal voltages, each horizontal period starting when supply of a corresponding instance of the reference voltage to the signal lines starts and ending when supply of a next instance of the reference voltage to the signal lines starts.

* * * * *